US011703778B2

(12) United States Patent
Stowitts

(10) Patent No.: US 11,703,778 B2
(45) **Date of Patent: *Jul. 18, 2023**

(54) METHOD AND APPARATUS OF DECORATING A METALLIC CONTAINER BY DIGITAL PRINTING TO A TRANSFER BLANKET

(71) Applicant: BALL CORPORATION, Westminster, CO (US)

(72) Inventor: Adam P. S. Stowitts, Arvada, CO (US)

(73) Assignee: BALL CORPORATION, Westminster, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/409,542

(22) Filed: Aug. 23, 2021

(65) Prior Publication Data

US 2021/0382414 A1 Dec. 9, 2021

Related U.S. Application Data

(63) Continuation of application No. 16/990,847, filed on Aug. 11, 2020, now Pat. No. 11,099,502, which is a (Continued)

(51) Int. Cl.
*G03G 15/16* (2006.01)
*B41M 3/12* (2006.01)
(Continued)

(52) U.S. Cl.
CPC ..... *G03G 15/161* (2013.01); *B41F 17/002* (2013.01); *B41F 17/22* (2013.01);
(Continued)

(58) Field of Classification Search
CPC ..... G03G 15/1605; G03G 15/1625; G03G 15/6591; B41F 17/002; B41F 17/22;
(Continued)

(56) References Cited

U.S. PATENT DOCUMENTS 3,752,073 A 8/1973 Lorber
3,766,851 A 10/1973 Sirvet et al.
(Continued)

FOREIGN PATENT DOCUMENTS

CA 2097619 5/1992
CN 101674940 3/2010
(Continued)

OTHER PUBLICATIONS

"Blanket for Offset Printing," Offset printing technology, 2016, 4 pages [retrieved online from: www.offsetprintingtechnology.com/sub-categories/blanket-for-offset-printing/].
(Continued)

*Primary Examiner* — Erika J. Villaluna
(74) *Attorney, Agent, or Firm* — Sheridan Ross P.C.

(57) ABSTRACT

An apparatus and methods of decorating a metallic container are provided. More specifically, the present invention relates to apparatus and methods used to provide a decoration or indicia on a predetermined portion of an outer surface of a metallic container body. The decorator includes at least one digital print unit, a transfer blanket, and a support element. The digital print unit transfers a decorating material to the transfer blanket to form a decoration on the transfer blanket. The support element then moves a metallic container into contact with the transfer blanket. In this manner, the decorating material is transferred to an exterior surface portion of the metallic container to decorate the metallic container. In one embodiment, the digital print unit is an electrophotographic system which transfers a toner material to the transfer blanket. In another embodiment, the digital print unit includes an inkjet print head which transfers an ink to the transfer blanket. Optionally, the decorator may include two or more support elements.

20 Claims, 12 Drawing Sheets

Related U.S. Application Data continuation of application No. 15/893,364, filed on Feb. 9, 2018, now Pat. No. 10,739,705, which is a continuation-in-part of application No. 15/674,363, filed on Aug. 10, 2017, now Pat. No. 10,754,277.

(60) Provisional application No. 62/373,134, filed on Aug. 10, 2016.

(51) Int. Cl.

| | |
|---|---|
| ***B41J 3/407*** | (2006.01) |
| ***B41F 17/00*** | (2006.01) |
| ***G03G 15/01*** | (2006.01) |
| ***B41J 2/01*** | (2006.01) |
| ***B41M 5/00*** | (2006.01) |
| ***G03G 15/00*** | (2006.01) |
| ***B41J 3/413*** | (2006.01) |
| ***B41J 11/00*** | (2006.01) |
| ***B41F 17/22*** | (2006.01) |
| *G03G 15/22* | (2006.01) |

(52) U.S. Cl.

CPC ..... *B41J 2/01* (2013.01); *B41J 3/4073* (2013.01); *B41J 3/40733* (2020.08); *B41J 3/413* (2013.01); *B41J 11/002* (2013.01); *B41J 11/00214* (2021.01); *B41M 3/12* (2013.01); *B41M 5/00* (2013.01); *B41M 5/0047* (2013.01); *B41M 5/0058* (2013.01); *B41M 5/0088* (2013.01); *G03G 15/0131* (2013.01); *G03G 15/6585* (2013.01); *G03G 15/6591* (2013.01); *B41J 2002/012* (2013.01); *B41M 2205/10* (2013.01); *G03G 15/225* (2013.01); *G03G 15/50* (2013.01); *G03G 15/6588* (2013.01)

(58) Field of Classification Search

CPC ..... B41J 3/4073; B41J 3/40733; B41J 3/413; B41M 3/12; B41M 5/0058; B41M 5/0088

See application file for complete search history.

(56) References Cited

U.S. PATENT DOCUMENTS

| | | | |
|---|---|---|---|
| 3,960,073 | A | 6/1976 | Rush |
| 3,991,673 | A | 11/1976 | Coale et al. |
| 4,142,462 | A | 3/1979 | Gilgore |
| 4,384,518 | A | 5/1983 | Albin |
| 4,395,946 | A | 8/1983 | Price |
| 4,481,878 | A | 11/1984 | Hoshi |
| 4,519,310 | A | 5/1985 | Shimizu et al. |
| 4,743,926 | A | 5/1988 | Schmidlin et al. |
| 4,773,326 | A | 9/1988 | Hudec |
| 4,884,504 | A | 12/1989 | Sillars |
| 4,889,560 | A | 12/1989 | Jaeger et al. |
| 4,898,752 | A | 2/1990 | Cavagna et al. |
| 4,903,599 | A | 2/1990 | Kubler et al. |
| 5,010,814 | A | 4/1991 | Shishikura |
| 5,018,640 | A | 5/1991 | Morofuji et al. |
| 5,049,432 | A | 9/1991 | Ooms et al. |
| 5,065,183 | A | 11/1991 | Morofuji et al. |
| 5,181,471 | A | 1/1993 | Sillars |
| 5,213,043 | A | 5/1993 | Reimers et al. |
| 5,282,306 | A | 2/1994 | Katsuhiro |
| 5,339,731 | A | 8/1994 | Howard et al. |
| 5,351,617 | A | 10/1994 | Williams et al. |
| 5,353,703 | A | 10/1994 | Rieker |
| 5,385,092 | A | 1/1995 | Lewis et al. |
| 5,469,787 | A | 11/1995 | Turner et al. |
| 5,502,476 | A | 3/1996 | Neal et al. |
| 5,591,255 | A | 1/1997 | Small et al. |
| 5,623,296 | A | 4/1997 | Fujino et al. |
| 5,713,288 | A | 2/1998 | Frazzitta |
| 5,750,303 | A | 5/1998 | Inaba et al. |
| 5,774,774 | A | 6/1998 | Tamura et al. |
| 5,908,505 | A | 6/1999 | Bargenquest et al. |
| 5,919,839 | A | 7/1999 | Titterington et al. |
| 5,970,865 | A | 10/1999 | Horth et al. |
| 5,974,974 | A | 11/1999 | Agnew et al. |
| 6,037,101 | A | 3/2000 | Telser et al. |
| 6,058,839 | A | 5/2000 | Frazzitta |
| 6,139,779 | A | 10/2000 | Small et al. |
| 6,174,937 | B1 | 1/2001 | Banning et al. |
| 6,196,675 | B1 | 3/2001 | Deily et al. |
| 6,238,837 | B1 | 5/2001 | Fan |
| 6,309,453 | B1 | 10/2001 | Banning et al. |
| 6,312,872 | B1 | 11/2001 | Murphy |
| 6,395,123 | B1 | 5/2002 | Fromson et al. |
| 6,494,950 | B1 | 12/2002 | Fujita et al. |
| 6,543,350 | B2 | 4/2003 | Gilliam et al. |
| 6,550,389 | B1 | 4/2003 | Goto et al. |
| 6,553,907 | B2 | 4/2003 | Richards |
| 6,594,927 | B2 | 7/2003 | Witkowski |
| 6,640,713 | B2 | 11/2003 | Landsman |
| 6,651,559 | B2 | 11/2003 | Haraux et al. |
| 6,709,096 | B1 | 3/2004 | Beach et al. |
| 6,719,423 | B2 | 4/2004 | Chowdry et al. |
| 6,769,357 | B1 | 8/2004 | Finan |
| 6,779,445 | B2 | 8/2004 | Schaede |
| 6,779,455 | B2 | 8/2004 | Figov et al. |
| 6,818,369 | B2 | 11/2004 | Sugiura et al. |
| 6,899,998 | B2 | 5/2005 | Figov |
| 6,920,822 | B2 | 7/2005 | Finan |
| 7,309,563 | B2 | 12/2007 | Paul et al. |
| 7,354,234 | B2 * | 4/2008 | Fujishige ..... B21D 51/26 72/46 |
| 7,373,878 | B2 | 5/2008 | Finan |
| 7,464,642 | B2 | 12/2008 | Schaede |
| 7,666,564 | B2 | 2/2010 | Asano et al. |
| 7,691,549 | B1 | 4/2010 | Glasser |
| 7,810,922 | B2 | 10/2010 | Gervasi et al. |
| 7,939,235 | B2 | 5/2011 | Honda et al. |
| 7,997,199 | B2 | 8/2011 | Watanabe et al. |
| 8,034,207 | B2 | 10/2011 | Hunahata |
| 8,409,698 | B2 | 4/2013 | Byers et al. |
| 8,544,385 | B2 | 10/2013 | Schuler-Cossette et al. |
| 8,596,624 | B2 | 12/2013 | Fleischer |
| 8,708,271 | B2 | 4/2014 | Noll et al. |
| 9,027,733 | B2 | 5/2015 | Coates |
| 9,259,913 | B2 | 2/2016 | Ellefson |
| 9,327,493 | B1 | 5/2016 | Vella |
| 9,340,368 | B2 | 5/2016 | Ellefson et al. |
| 9,381,736 | B2 | 7/2016 | Landa et al. |
| 9,409,433 | B2 | 8/2016 | Carreras |
| 9,550,372 | B2 | 1/2017 | Vella |
| 9,555,616 | B2 | 1/2017 | Carreras et al. |
| 10,739,705 | B2 | 8/2020 | Stowitts |
| 10,754,277 | B2 | 8/2020 | Stowitts |
| 11,099,502 | B2 | 8/2021 | Stowitts |
| 2002/0083855 | A1 | 7/2002 | Samworth |
| 2002/0178945 | A1 | 12/2002 | Richards |
| 2003/0015105 | A1 | 1/2003 | Dewig |
| 2003/0056410 | A1 | 3/2003 | Witkowski |
| 2003/0089261 | A1 | 5/2003 | Landsman |
| 2003/0101885 | A1 | 6/2003 | Jordan |
| 2003/0150346 | A1 | 8/2003 | Haraux et al. |
| 2004/0011234 | A1 | 1/2004 | Figov et al. |
| 2004/0173110 | A1 | 9/2004 | Roesch |
| 2004/0191693 | A1 | 9/2004 | Takamiya |
| 2005/0098051 | A1 | 5/2005 | Flint et al. |
| 2006/0019196 | A1 | 1/2006 | Miyoshi |
| 2006/0068313 | A1 | 3/2006 | Nakayama et al. |
| 2006/0137548 | A1 | 6/2006 | Vetter |
| 2009/0290891 | A1 | 11/2009 | Sievers |
| 2009/0303307 | A1 | 12/2009 | Yasumatsu |
| 2010/0031834 | A1 | 2/2010 | Morgavi et al. |
| 2010/0229737 | A1 | 9/2010 | Ouchi |
| 2010/0295885 | A1 | 11/2010 | LaCaze |
| 2010/0319555 | A1 | 12/2010 | Hashimoto et al. |
| 2011/0104615 | A1 | 5/2011 | Sievers |
| 2011/0126760 | A1 | 6/2011 | Daems et al. |
| 2011/0162542 | A1 | 7/2011 | Nakamura et al. |

(56) References Cited

U.S. PATENT DOCUMENTS

| | | | |
|---|---|---|---|
| 2011/0283905 | A1 | 11/2011 | Sakata |
| 2012/0017783 | A1 | 1/2012 | Uptergrove |
| 2012/0103216 | A1 | 5/2012 | Knisel et al. |
| 2012/0204746 | A1 | 8/2012 | Fullgraf |
| 2012/0216689 | A1 | 8/2012 | Cochran et al. |
| 2012/0238675 | A1 | 9/2012 | Kataura et al. |
| 2012/0272846 | A1 | 11/2012 | Fleischer et al. |
| 2012/0274695 | A1 | 11/2012 | LaCaze et al. |
| 2012/0294658 | A1 | 11/2012 | Aoki et al. |
| 2012/0315412 | A1 | 12/2012 | Clayton et al. |
| 2013/0068352 | A1 | 3/2013 | Siles et al. |
| 2013/0075675 | A1 | 3/2013 | Krutak et al. |
| 2013/0098256 | A1 | 4/2013 | Bonner |
| 2013/0105743 | A1 | 5/2013 | Owen et al. |
| 2013/0176358 | A1 | 7/2013 | Yamada et al. |
| 2013/0228086 | A1 | 9/2013 | Baldwin et al. |
| 2013/0231242 | A1 | 9/2013 | Clayton et al. |
| 2013/0242276 | A1 | 9/2013 | Schadebrodt et al. |
| 2013/0305942 | A1 | 11/2013 | Gila et al. |
| 2013/0340885 | A1 | 12/2013 | Clayton et al. |
| 2014/0039091 | A1 | 2/2014 | Owen et al. |
| 2014/0072442 | A1 | 3/2014 | Bowman et al. |
| 2014/0187668 | A1 | 7/2014 | Owen et al. |
| 2014/0210201 | A1 | 7/2014 | Owen et al. |
| 2014/0212654 | A1 | 7/2014 | Clayton et al. |
| 2014/0272161 | A1 | 9/2014 | Clayton et al. |
| 2014/0298641 | A1 | 10/2014 | Siles et al. |
| 2014/0373741 | A1 | 12/2014 | Wilkinson |
| 2015/0118503 | A1 | 4/2015 | Landa et al. |
| 2015/0017891 | A1 | 6/2015 | Boas et al. |
| 2015/0174891 | A1 | 6/2015 | Boas et al. |
| 2015/0183211 | A1 | 7/2015 | Petti et al. |
| 2015/0290923 | A1 | 10/2015 | Treloar |
| 2015/0336750 | A1 | 11/2015 | Coates et al. |
| 2016/0001546 | A1 | 1/2016 | Hughes et al. |
| 2016/0129687 | A1 | 5/2016 | Boas et al. |
| 2016/0200097 | A1 | 7/2016 | Shmaiser et al. |
| 2016/0347048 | A1 | 12/2016 | Carreras |
| 2017/0008270 | A1 | 1/2017 | Fleischer et al. |
| 2017/0008272 | A1 | 1/2017 | Landa et al. |
| 2017/0087872 | A1 | 3/2017 | Vella |
| 2017/0096001 | A1 | 4/2017 | Carreras et al. |
| 2017/0113452 | A1 | 4/2017 | Boas et al. |
| 2017/0182705 | A1 | 6/2017 | Allen et al. |
| 2017/0334659 | A1 | 11/2017 | Leitzen et al. |
| 2018/0009216 | A1 | 1/2018 | Egerton et al. |
| 2019/0257692 | A1 | 8/2019 | Cochran |

FOREIGN PATENT DOCUMENTS

| | | |
|---|---|---|
| CN | 101808825 | 8/2010 |
| CN | 105531629 | 4/2016 |
| DE | 102006025897 | 1/2007 |
| EP | 202928 | 11/1986 |
| EP | 545862 | 6/1993 |
| EP | 0717320 | 6/1996 |
| EP | 968491 | 1/2000 |
| EP | 1590177 | 11/2005 |
| EP | 1684990 | 8/2006 |
| EP | 1011971 | 7/2009 |
| EP | 2153991 | 2/2010 |
| EP | 2196314 | 6/2010 |
| EP | 2242595 | 10/2010 |
| EP | 2317387 | 5/2011 |
| EP | 2384890 | 11/2011 |
| EP | 2701912 | 3/2014 |
| EP | 2809521 | 12/2014 |
| EP | 2943339 | 11/2015 |
| GB | 1298205 | 11/1972 |
| GB | 2512678 | 10/2014 |
| JP | 2000-258899 | 9/2000 |
| JP | 2001/030612 | 2/2001 |
| JP | 2007/076209 | 3/2007 |
| JP | 2013-533135 | 8/2013 |
| KR | 10-2006-0004679 | 1/2006 |
| WO | WO 1990/02044 | 3/1990 |
| WO | WO 94/07693 | 4/1994 |
| WO | WO 98/17474 | 4/1998 |
| WO | WO 98/41966 | 9/1998 |
| WO | WO 00/27644 | 5/2000 |
| WO | WO 2009/090389 | 7/2009 |
| WO | WO 2013/028804 | 2/2013 |
| WO | WO 2013/113616 | 8/2013 |
| WO | WO 2013/115800 | 8/2013 |
| WO | WO 2013/155423 | 10/2013 |
| WO | WO 2014/006517 | 1/2014 |
| WO | WO 2014/008544 | 1/2014 |
| WO | WO 2014/096088 | 6/2014 |
| WO | WO 2014/108489 | 7/2014 |
| WO | WO 2014/128200 | 8/2014 |
| WO | WO 2014/144853 | 9/2014 |
| WO | WO 2014/152858 | 9/2014 |
| WO | WO 2015/101828 | 7/2015 |
| WO | WO 2016/183452 | 11/2016 |
| WO | WO 2017/208145 | 12/2017 |
| WO | WO 2017/208146 | 12/2017 |
| WO | WO 2018/013465 | 1/2018 |
| WO | WO 2018/019912 | 2/2018 |
| WO | WO 2019/060394 | 3/2019 |
| WO | WO 2019/060396 | 3/2019 |

OTHER PUBLICATIONS

Certified Copy of GB 1609469.0, filed May 30, 2016, 22 pages.
Certified Copy of GB 1613713.5, filed Aug. 9, 2016, 36 pages.
"Chemical milling," Wikipedia, Feb. 13, 2015, retrieved from http://en.wikipedia.org/wiki/Chemical_milling, 6 pages.
"Cyrel® DSP High Performance Plate," DuPont, 2016, 2 pages [retrieved online from: www.dupont.com/produts-and-services/printing-package-printing/flexographic-platemaking-systems/brands/cyrel/products/sub-products/cyrel-dsp.html].
"Dry offset Printing," Encyclopaedia Britannica, 2016, 2 pages [retrieved online from: www.britannica.com/technology/dry-offset].
"DuPont™ Cyrel®: CyrelTM Digital flex plate Imagers (CDI)" DuPont, 2009, retrieved from http://www2.dupont.com/Packaging_Graphics/en_GB/assets/downloads/pdf/CDI_family_English.pdf, 8 pages.
"DuPont™ Cyrel® DPR: Robust Digital Plate for Highest Quality Printing," DuPont, 2010, retrieved from http://www2.dupont.com/Packaging_Graphics/en_US/assets/downloads/pdf/DP_Cyrel_DS_DPR_us_low.pdf, 2 pages.
"DuPont™ Cyrel® NOWS: Rugged, High-Performance Analog Plate," DuPont, 2007, retrieved from http://www2.dupont.com/Packaging_Graphics/en_US/assets/downloads/pdf/Cyrel_NOWS.pdf, 2 pages.
"EPDM rubber," Wikipedia, Oct. 24, 2014, retrieved from http://enwikipedia.org/wiki/EPDM_rubber, 3 pages.
"Flexographic ink," Wikipedia, Sep. 18, 2014, retrieved from http://en.wikipedia.org/wiki/Flexographic_ink, 2 pages.
"Flexography," Wikipedia, Dec. 15, 2014, retrieved from http://en.wikipedia.org/wiki/Flexographic, 6 pages.
"Inside a Ball Beverage Can Plant," Ball, Sep. 2002, 1 page [retrieved online from: www.ball.com/Ball/media/Ball/Global/Downloads/How_a_Ball_Metal_Beverage_Can_Is_Made.pdf?ext=.pdf].
"Electrophotographic," Image Permanence Institute, 2016, 2 pages [retrieved online from: www.dp3project.org/print/technologies/digital-printing/electrophotographic].
"Electrophotographic Plate," PrintWiki, 1 page [retrieved online Jul. 8, 2017, from: printwiki.org/Electrophotographic_Plate.
"Electrophotography," PrintWiki, 1 page [retreived online Jul. 8, 2017 from: printwiki.org/Electrophotography].
"Laser engraving," Wikipedia, Jan. 16, 2015, retrieved from http://en.wikipedia.org/wiki/Laser_engraving, 10 pages.
"Luminous paint," Wikipedia, Jul. 7, 2014, retrieved from http://en.wikipedia.org/wiki/Luminous_paint, 4 pages.
"Offset Lithography," PrintWiki, retrieved Feb. 9, 2015 from http://printwiki.org/Offset_Lithography, 8 pages.

(56) References Cited

OTHER PUBLICATIONS

"Offset printing," Offset printing technology, 2016, 4 pages [retrieved online from: www.offsetprintingtechnology.com].
"Offset printing," Wikipedia, Dec. 11, 2014, retrieved from http://en.wikipedia.org/wiki/Offset_printing, 12 pages.
"Offset Printing/Dry Offset," Buse Printing & Packaging, 2016, 1 page [retrieved online from: buseprinting.com/offset_printing.html].
"Offset printing," BusinessDictionary.com, 2015, 2 pages [retrieved online from: www.businessdictionary.com/definition/offset-printing.html].
"Plate," PrintWiki, retrieved Feb. 9, 2015 from http://printwiki.org/Plate, 6 pages.
"Printmaking," Wikipedia, Feb. 12, 2015, retrieved from http://en.wikipedia.org/wiki/Printmaking, 14 pages.
"Toner," Wikipedia, last edited May 28, 2017, 4 pages [retrieved online from: en.wikipedia.org/wiki/Toner].
"What is offset printing (offset lithography)?" TechTarget, 2016, 13 pages [retrieved online from: whatis.techtarget.com/definition/offset-printing-offset-lithography].
"Xerography," Wikipedia, last modified Aug. 4, 2016, 3 pages [retrieved online from: en.wikipedia.org/wiki/Xerography].
Bodwell et al., "Advancing Flexography: The Technical Path Forward," DuPont, 2011, retrieved from www2.dupont.com/Packaging_Graphics/en_US/assets/downloads/pdf/AdvFlexo_Brochure.pdf, 12 pages.
Ientilucci "Fundamentals of Xerography," Rochester Institute of Technologhy, Feb. 22, 1994, 9 pages.
Mine, "How Offset Printing Works," retrieved on Feb. 9, 2015 from www.howstuffworks.com/offset-printing.htm/printable, 5 pages.
International Search Report and Written Opinion for International (PCT) Patent Application No. PCT/US17/46358, dated Dec. 21, 2017 10 pages.
Official Action for Australia Patent Application No. 2017311515, dated Aug. 5, 2019 4 pages.
Official Action for Canada Patent Application No. 3,032,964, dated Oct. 16, 2019 6 pages.
Official Action for Canada Patent Application No. 3,032,964, dated Feb. 23, 2021 5 pages.
Extended Search Report for European Patent Application No. 17840302.8, dated Mar. 10, 2020 8 pages.
Official Action with English Translation for Russia Patent Application No. 2019106523, dated Nov. 18, 2019 7 pages.
Notice of Allowance for Russia Patent Application No. 2019106523, dated Mar. 11, 2020 15 pages.
International Search Report and Written Opinion for International (PCT) Patent Application No. PCT/US19/17301, dated Apr. 23, 2019 22 pages.
International Preliminary Report on Patentability for International (PCT) Patent Application No. PCT/US2019/017301, dated Aug. 20, 2020 16 pages.
Official Action for U.S. Appl. No. 15/674,363, dated Apr. 6, 2018 9 pages.
Official Action for U.S. Appl. No. 15/674,363, dated Jun. 26, 2019 13 pages.
Third Party Description of Relevance of WO 2014/108489 & US 2010/0031834 for U.S. Appl. No. 15/893,364, dated Dec. 31, 2018 12 pages.
Third Party Description of Relevance of WO 2017/208145, GB 1613713.5, GB 1609469.0, WO 2014/108489 & US 2010/0031834 for U.S. Appl. No. 15/893,364, dated Dec. 31, 2018 18 pages.
Official Action for U.S. Appl. No. 15/674,363, dated Jan. 30, 2019 14 pages.
Official Action for U.S. Appl. No. 15/674,363, dated Dec. 31, 2019 14 pages.
Notice of Allowance for U.S. Appl. No. 15/674,363, dated Apr. 7, 2020 6 pages .
Official Action for U.S. Appl. No. 15/893,364, dated Jan. 11, 2019 10 pages.
Official Action for U.S. Appl. No. 15/893,364, dated Jul. 29, 2019 13 pages.
Official Action for U.S. Appl. No. 15/893,364, dated Dec. 18, 2019 16 pages.
Notice of Allowance for U.S. Appl. No. 15/893,364, dated Mar. 30, 2020 5 pages.
Corrected Notice of Allowance for U.S. Appl. No. 15/893,364, dated May 12, 2020 2 pages.
Official Action for U.S. Appl. No. 16/990,847, dated Jan. 4, 2021 15 pages.
Notice of Allowance for U.S. Appl. No. 16/990,847, dated Apr. 16, 2021 9 pages.
Official Action with English Translation for Brazil Patent Application No. BR112019002542-1, dated Jun. 25, 2021 5 pages.
Notice of Allowance with machine translation for Israel Patent Application No. 264669, dated Nov. 4, 2021 5 pages.
Official Action for Australia Patent Application No. 2019216765, dated Apr. 30, 2021 5 pages.
Official Action for Canada Patent Application No. 3,090,266, dated Oct. 27, 2021 4 pages.
Official Action with English Translation for China Patent Application No. 201980018673.0, dated Jul. 29, 2021 26 pages.
Extended Search Report for European Patent Application No. 19750534.0, dated Sep. 27, 2021 8 pages.
Decision to Grant for Russia Patent Application No. 2020129647/28, dated Jul. 15, 2021 17 pages.
Official Action with English Translation for Russia Patent Application No. 2020129647, dated Feb. 9, 2021 13 page.
Notice of Allowance for Canada Patent Application No. 3,032,964, dated Nov. 19, 2021 1 page.
Official Action for European Patent Application No. 17840302.8, dated Feb. 22, 2022 5 pages.
Official Action with English Summary for Mexico Patent Application No. MX/a/2019/001607, dated Apr. 1, 2022, 4 pages.
Notice of Acceptance for Australia Patent Application No. 2019216765, dated Mar. 3, 2022 4 pages.
Notice of Allowance with English Translation for China Patent Application No. 201980018673.0, dated Mar. 3, 2022 7 pages.

* cited by examiner

METHOD AND APPARATUS OF DECORATING A METALLIC CONTAINER BY DIGITAL PRINTING TO A TRANSFER BLANKET

CROSS-REFERENCE TO RELATED APPLICATIONS

This application is a Continuation application of, and claims priority to, U.S. patent application Ser. No. 16/990,847, filed Aug. 11, 2020, which issued as U.S. Pat. No. 11,099,502 on Aug. 24, 2021, which is a continuation application and claims the benefit and priority of U.S. patent application Ser. No. 15/893,364, filed Feb. 9, 2018, which issued as U.S. Pat. No. 10,739,705 on Aug. 11, 2020, which is a continuation-in-part application and claims the benefit and priority of U.S. patent application Ser. No. 15/674,363, filed Aug. 10, 2017, which issued as U.S. Pat. No. 10,754,277 on Aug. 25, 2020, which claims priority under 35 U.S.C. § 119(e) to U.S. Provisional Patent Application Ser. No. 62/373,134, filed Aug. 10, 2016 and entitled "Method and Apparatus of Decorating a Metallic Container by Digital Printing to a Transfer Blanket," which are all incorporated herein by reference in their entirety by reference.

FIELD OF THE INVENTION

The present invention relates generally to decorating containers. More specifically, the present invention provides a novel apparatus and method which uses a digital print unit to form a decoration on a transfer blanket. The transfer blanket then contacts an exterior surface portion of a metallic container and the decoration is transferred to the exterior surface of the metallic container.

BACKGROUND

Metallic beverage containers offer distributors and consumers many benefits. The metallic body of a beverage container provides optimal protection properties for products. For example, the metallic body prevents $CO_2$ migration and transmission of UV radiation which may damage beverages, negatively influencing the flavor, appearance, or color of the product. Metallic beverage containers also offer an impermeable barrier to light, water vapor, oils and fats, oxygen, and micro-organisms and keep the contents of the container fresh and protected from external influences, thereby guaranteeing a long shelf-life. The surfaces of metallic containers are also ideal for decorating with brand names, logos, designs, product information, and/or other preferred indicia for identifying, marketing, and distinguishing the metallic container and its contents from other products and competitors. Thus, metallic containers offer bottlers, distributors, and retailers an ability to stand out at the point of sale.

The increased durability of metallic beverage containers compared to glass containers reduces the number of containers damaged during processing and shipping, resulting in further savings. Additionally, metallic beverage containers are lighter than glass containers of comparable size, resulting in energy savings during shipment. Further, metallic beverage containers can be manufactured with high burst pressures which make them ideal and safe for use as containers holding products under pressure, such as containers for carbonated beverages and aerosol products.

Additionally, many consumers prefer metallic containers compared to containers made of glass or plastic. Metallic containers are particularly attractive to consumers because of their convenience. The light weight of metallic containers makes them easier to carry than glass containers. Metallic containers are particularly suitable for use in public places and outdoors because they are more durable than glass containers. Further, some consumers avoid plastic containers due to concerns that the plastic may leach chemicals into consumable products.

As a result of these benefits, sales of metallic containers were valued at approximately $53 billion globally in 2014. A large percentage of the metallic container market is driven by beverage containers. According to one report, approximately 290 billion metallic beverage containers were shipped globally in 2012. One U.S. trade group reported that 126 billion metallic containers were shipped in the U.S. alone in 2014. To meet this demand, metallic container manufacturing facilities operate some of the fastest, if not the fastest, production lines in the container industry. Because of the high speeds of container production lines, techniques or processes that may work in other industries or with containers formed of other materials do not necessarily work at the high speeds required for metallic container production lines. Accordingly, specialized equipment and techniques are often required for many of the operations used to form and decorate metallic containers.

Metallic containers are frequently decorated with an image or indicia, such as a brand name, logo, product information, or design, by a contact printing method, such as a lithographic or off-set printing process. Contact printing methods and apparatus are described in U.S. Pat. Nos. 3,766,851, 3,960,073; 4,384,518; 6,550,389; 6,899,998; U.S. Patent App. Pub. No. 2012/0272846; U.S. Patent App. Pub. No. 2014/0360394; U.S. Patent App. No. 2015/0183211; U.S. Patent App. Pub. No. 2015/0217559; WIPO Publication No. WO 2013/113616; WIPO Publication No. WO 2014/006517; WIPO Publication No. WO 2014/008544; WIPO Publication No. WO 2014/108489; and WIPO Publication No. WO 2014/128200 which are each incorporated herein by reference in their entireties.

Alternatively, metallic containers may be decorated by a non-contact printing process. A variety of non-contact printing processes are generally described in U.S. Pat. Nos. 5,018,640, 6,769,357, 6,920,822, and 7,373,878 which are each incorporated herein by reference in their entireties.

One non-contact printing process is known as "Direct to Can" printing in which a print head applies ink directly to a container. One example of this technology is generally described in U.S. Pat. No. 9,327,493, which is incorporated herein in its entirety by reference. Some direct to can printing systems include inkjet print units. Inkjet printing processes have been difficult to provide at high speed and while maintaining print quality without distortion. This is because increasing the resolution of decorations formed with the prior art direct to can printing units generally decreases the rate at which metallic containers can be decorated. For example, some prior art direct to can printing units can decorate about 200 metallic containers per minute with an image resolution of 180 dpi. However, decorations with a resolution of only 180 dpi are not considered high-definition and are not of the high quality sought by consumers and advertisers. Other known direct to can printing units can decorate approximately 90 metallic containers per minute at a resolution of 700 dpi. This rate is too slow for beverage container manufacturing lines in which production equipment, including decorators, typically must operate at 500-3,000 metallic containers per minute. More preferably, decorators may be required to operate at production speeds of at least one thousand, and even more preferably, several thousand cylindrical metallic containers per minute.

Due to the limitations associated with existing methods and apparatus used to decorate metallic containers, there is an unmet need for an apparatus and method of decorating metallic containers at high speeds without sacrificing production efficiency or image quality in a high-speed beverage container production system.

SUMMARY OF THE INVENTION

The present invention provides various apparatus and methods for decorating metallic containers in a cost-effective, fast, and reliable manner. One aspect of the present invention is an apparatus and method that utilizes digital print units to create an image on an intermediate substrate (such as a transfer blanket). The digital print units create the image with a decorating material. In one embodiment, the decorating material is one of an ink and a toner. The transfer blanket subsequently transfers the image to an exterior surface portion of a metallic container, an end closure of a metallic container, a roll-on pilfer proof (ROPP) closure, or a crown cap.

In one embodiment, the digital print units comprise inkjet printers or inkjet print heads that form images on the transfer blanket. In this embodiment, the decorating material comprises an ink. In one embodiment, the inkjet printers transfer at least one color or type of ink to the transfer blanket. In another embodiment, one or more of the inkjet printers may transfer more than one color or type of ink to the transfer blanket.

In one embodiment, the apparatus can alter the viscosity of the ink conveyed by the inkjet print heads such that a first ink has a first viscosity and a second ink has a second viscosity. The apparatus can alter the viscosity by one or more of: adjusting the temperature of the ink and exposing initiators in the ink to specific wavelengths light. Optionally, the light may be an ultra-violent (UV) light. In one embodiment, the apparatus can alter the viscosity of an ink before the ink is conveyed from an inkjet print head.

Additionally, or alternatively, the apparatus can alter the viscosity of an ink after the ink is conveyed by an inkjet print head to the transfer blanket. In one embodiment, the apparatus includes a temperature control device operable to heat or cool the transfer blanket to a predetermined temperature. Optionally, in another embodiment, the apparatus includes an emitter to expose initiators in the ink on the transfer blanket to light of a specific wavelength. In each of these ways, the apparatus can alter the viscosity of an ink on the transfer blanket.

In another embodiment, one or more of the digital print units may comprise electrophotographic digital print units with an electrophotographic drum to form images on the transfer blanket. The electrophotographic digital print units utilize a toner material which is applied to the electrophotographic drum to form an image. The image formed of the toner is subsequently transferred to the transfer blanket and then to the metallic container. In one embodiment, the apparatus includes a plurality of electrophotographic digital print units. Optionally, each of the electrophotographic digital print units forms a portion of the image. In one embodiment, the electrophotographic digital print units transfer one color or type of toner to the transfer blanket. In another embodiment, one or more of the electrophotographic digital print units may transfer more than one color or type of toner to the transfer blanket.

In one embodiment, a first electrophotographic digital print unit forms a first portion of an image with a first toner of a first color. A second electrophotographic digital print unit forms a second portion of the image with a second toner of a second color. One or more additional electrophotographic digital print units may similarly form portions of the image with one or more other colors of toner. In one embodiment, the toner material comprises particles of one or more colors.

Optionally, the toner may be a fine powder. In one embodiment, the toner may be electrically charged. In another embodiment, the toner has a polarity which is the opposite of a polarity of an electrical charge of the electrophotographic drum. In one embodiment, the toner may include a carrier. Optionally, the carrier comprises particles mixed with particles of the toner. In one embodiment, the carrier particles are larger than the toner particles. In another embodiment, the carrier particles are magnetic. Additionally, or alternatively, the carrier particles may have an electrical charge.

Another aspect of the present invention is a decorator that includes at least one digital print unit operable to form a decoration on a transfer blanket. The decoration comprises a decorating material that is subsequently transferred from the transfer blanket to an exterior surface portion of a metallic container. In one embodiment, the decorating material comprises particles of a toner. In another embodiment, the decorating material comprises an ink. As will be appreciated by one of skill in the art, the apparatus and methods described herein can be utilized on any type of surface or container, and are not limited to cylindrical metallic containers. Accordingly, the apparatus and methods of the present invention may be utilized to decorate a closure for a container such as, but not limited to, an end closure adapted for interconnection to a neck of the container, a ROPP closure adapted for interconnection to a threaded neck of the container, or a crown cap adapted for interconnection to a neck of the container.

It is another aspect of the present invention to integrate the benefits of digital printing into a high-speed metallic container decoration system. Another aspect of the present invention is a high-speed decorator that eliminates problems and downtime associated with changing and registering printing plates and can efficiently decorate small batches of decorated metallic containers or a plurality of metallic containers each decorated with a unique decoration. Yet another aspect of the present invention is a method and apparatus that provides accurate, high-definition, and variable decorations for metallic containers while minimizing or eliminating equipment changeovers and down-time on a high-speed metallic container production line. The decorator may be used to transfer decorations to one or more of a metallic container, an end closure for a metallic container, a ROPP closure, and a crown cap. More specifically, in one embodiment, the decorator includes a digital print unit that forms a decoration comprising a decorating material on a transfer blanket. The transfer blanket subsequently transfers the decoration to one of a metallic container, a ROPP closure, and a crown cap. In one embodiment, the transfer blanket is a continuous loop or belt of material. The decoration may be formed of at least one of an ink and a toner. In one embodiment, the digital print unit include an inkjet print head which forms the decoration with the ink. In another embodiment, the digital print unit is an electrophotographic system which forms the decoration with the toner.

Another aspect of the present invention is a decorator configured to convey a first ink to a transfer blanket and subsequently transfer a second ink to the transfer blanket while the first ink is wet or uncured. In this manner, the decorator is operable form a decoration on the transfer blanket comprising the first and second inks. The decorator can subsequently transfer the decoration from the transfer blanket to an exterior surface of a metallic container. Optionally, the decorator can convey from two to eight inks to the transfer blanket to form the decoration while maintaining one or more of the inks in an uncured state. After the decoration is formed by two or more inks, the two or more inks of the decoration can be cured by a curing unit. In one embodiment, the decorator can transfer from two to eight inks to the transfer blanket before curing a first ink of the two to eight inks.

The decorator can include a first digital print unit to convey the first ink. A second digital print unit can convey the second ink. Optionally, the first and second digital print units are arranged such that the first digital print unit conveys the first ink and then the second digital print unit conveys the second ink.

In one embodiment, the first and second digital print units comprise inkjet print heads. A first inkjet print head is configured to convey a first ink to the transfer blanket. A second inkjet print head is configured to convey a second ink to the transfer blanket before the first ink is cured. Optionally, the first and second inks are of the same color.

The decorator can adjust a viscosity of each of the first and second inks. For example, in one embodiment, the decorator adjusts the first ink to a first viscosity. The second ink is adjusted to a different, second viscosity by the decorator. In this manner, the first ink can have the first viscosity when conveyed by the first digital print unit and the second ink can have the second viscosity when conveyed by the second digital print unit.

In one embodiment, altering or adjusting the viscosities of the first and second inks changes the size of dots or drops of the first and second inks such that the first and second inks can be conveyed to the transfer blanket in proximity to each other to form the decoration while the first and second inks are wet or uncured. Additionally, or alternatively, altering the viscosity of the first ink prevents unintended or inadvertent movement of dots or drops of the first ink on the transfer blanket such that the second ink can be conveyed to the transfer blanket before the first ink is cured.

In one embodiment, the decorator is configured to alter the temperature of the first and second inks to adjust the viscosities of the inks. The digital print units may include a temperature control device to alter the temperature of the inks. Optionally, a control system of the decorator can send a signal to a temperature control device associated with a digital print unit to alter a temperature of an ink supplied to the digital print unit. The control system can send a first signal to a first temperature control device to heat (or cool) the first ink to a first temperature and send a second signal to a second temperature control device to cool (or heat) the second ink to a second temperature. In this manner, the viscosities of the first and second inks can be adjusted.

Additionally, or alternatively, the decorator can activate one or more initiators in an ink to alter a viscosity of the ink. In one embodiment, the initiators are photo-initiators. More specifically, in one embodiment, the initiators are activated by exposure to light of a predetermined wavelength. Optionally, the initiators are activated by UV light of a predetermined wavelength. The decorator can include a least one light configured to emit light of the predetermined wavelength to activate initiators in an ink. Accordingly, the decorator can alter the viscosity of the ink. In one embodiment, the light can alter the viscosity of the ink before the ink is conveyed from an inkjet print head. Optionally, in another embodiment, the light can alter the viscosity of the ink after the ink has been conveyed to the transfer blanket.

In one embodiment, the decorator includes a temperature control device configured to heat or cool the transfer blanket to a predetermined temperature. In this manner, a size of drops of ink on the transfer blanket can be altered. Additionally, or alternatively wetness of the ink on the transfer blanket can be changed.

One aspect of the present invention is a method of forming a decoration on an exterior surface of a cylindrical container. The method includes, but is not limited to: (1) charging a conductor of an electrophotographic system; (2) irradiating the surface of the conductor with light to form a latent electrostatic image thereon; (3) developing the latent electrostatic image with a toner to form a toner image on the conductor surface; (4) transferring the toner image to a transfer blanket; and (5) transferring the toner image from the transfer blanket to the exterior surface of the cylindrical container. Optionally the method further comprises curing the toner image by a curer. In one embodiment, the toner image is at least partially cured on the transfer blanket. In another embodiment, the toner image is cured after transfer to the exterior surface of the cylindrical container. In one embodiment, the curer uses heat to cure the toner image.

It is one aspect of the present invention to provide an apparatus for decorating a metallic workpiece. The apparatus generally includes, but is not limited to: (1) a transfer blanket; (2) a digital print unit in a predetermined alignment with respect to the transfer blanket, the digital print unit operable to apply or convey a decorating material to the transfer blanket; and (3) a feed unit to move a metallic workpiece into contact with the transfer blanket to transfer at least some of the decorating material from the transfer blanket to the metallic workpiece. In this manner, the apparatus forms a decoration on an exterior surface portion of the metallic workpiece. Optionally, the metallic workpiece comprises one of a metallic container, an end closure for a metallic container, a ROPP closure, and a crown cap.

In one embodiment, the feed unit comprises at least a first feed unit and a second feed unit. The first feed unit is positioned with respect to the transfer blanket at a first image transfer position. The second feed unit is positioned with respect to the transfer blanket at a second image transfer position. In this manner, alternating decorations formed by the digital print unit on the transfer blanket are transferred to metallic workpieces supported by the first and second feed units. In one embodiment, a first decoration on the transfer blanket is transferred to a first metallic workpiece supported by the first feed unit. A second decoration on the transfer blanket is transferred to a second metallic workpiece supported by the second feed unit. The second decoration is sequentially positioned on the transfer blanket with the first decoration.

The decoration may include any indicia such as, but not limited to, a brand name, a logo, product information, or a design. The decoration may include, but is not limited to, one or more of a symbol, an image, a letter, and a numeral. In one embodiment, the decorating material is one of a toner material and an ink. In one embodiment, the toner material comprises a fine powder.

In one embodiment, the digital print unit comprises an inkjet print head. In another embodiment, the digital print unit is operable to jet a plurality of colors of ink to the transfer blanket. Alternatively, the digital print unit is operable to jet a single color of ink to the transfer blanket.

Optionally, the decorator is configured to alter a viscosity of an ink. In one embodiment, the decorator includes a temperature control device to heat or cool the ink to a predetermined temperature. The decorator may also include a temperature control device to alter a temperature of the transfer blanket. In another embodiment, the ink supplied to the inkjet print head includes at least a first initiator which can be activated by light of a predetermined wavelength. When activated, a first initiator can increase the viscosity of the ink. The ink may include a second initiator which can be activated by light of a second wavelength. When the second initiator is activated, the viscosity of the ink decreases. Optionally, the decorator includes a light configured to expose the ink to the predetermine wavelength required to activate the first initiator. Additionally, the decorator may include a second light to expose the ink to the second wavelength required to activate the second initiator.

In another embodiment, the digital print unit comprises an electrophotographic system. The electrophotographic system includes an electrophotographic drum or conductor. The electrophotographic system is operable to transfer toner material to the transfer blanket. More specifically, in one embodiment, toner material is attracted to predetermined portions of the electrophotographic drum to form a decoration. The toner material is subsequently transferred from the electrophotographic drum to the transfer blanket. In one embodiment, the electrophotographic system includes the electrophotographic drum, a charging element, an exposure element, and a developer unit with a supply of toner material. The toner material may be of one or more colors. In one embodiment, the toner material includes at least one of a carrier and a colorant.

In one embodiment, a single digital print unit forms a complete decoration on the transfer blanket. In another embodiment, the digital print unit includes from two to ten digital print units. Optionally, each of the two to ten digital print units forms a portion of the decoration on the transfer blanket.

In one embodiment, the transfer blanket comprises a single continuous sheet or loop of material, such as a belt. In another embodiment, the transfer blanket comprises a plurality of individual transfer blanket segments. In one embodiment, the individual transfer blanket segments are interconnected to a blanket wheel. Optionally, the individual transfer blanket segments may change velocity after the digital print unit applies the decorating material to the transfer blanket. In this manner, an individual transfer blanket segment can match a velocity of the exterior surface of the metallic workpiece in the feed unit. In another embodiment, the individual transfer blanket segments have a first spacing proximate to the digital print unit and a second greater spacing proximate to the feed unit.

In one embodiment, each transfer blanket segment is positioned at a distal end of a blanket support extending from the blanket wheel. The blanket supports are configured to alter a position of their respective transfer blanket segments with respect to the blanket wheel. In one embodiment, a distance between the blanket wheel and a transfer blanket segment can be altered by movement of an associated blanket support. In another embodiment, a blanket support can move an associated transfer blanket segment radially with respect to the blanket wheel. Optionally, a blanket support can pivot with respect to the blanket wheel. In one embodiment, the blanket support includes a first section pivotally connected to a second section. In another embodiment, the blanket support has a length that is variable. Additionally, or alternatively, the blanket wheel can include a recess or a bore to receive at least a portion of the blanket support. Accordingly, the blanket support can retract into, or extend out of, the blanket wheel.

In one embodiment, the apparatus includes at least one tensioning device to adjust a tension of the transfer blanket. Optionally, the tension of the transfer blanket is selected to counteract a force received from the metallic workpiece during the transfer of the decorating material to the metallic workpiece. In one embodiment, the tensioning device is adjustably positionable with respect to an interior surface of the transfer blanket. Optionally, the tensioning device is positioned proximate to an image transfer position at which the decorating material on an exterior surface of the transfer blanket is transferred to the metallic workpiece. In one embodiment, the tensioning device may be associated with an actuator. The actuator may alter the position of the tensioning device in response to a signal received from a control system.

Optionally, in another embodiment, the apparatus may include one or more of a control system, a curing unit, and a cleaning system. The cleaning system is operable to remove residual decorating material from the transfer blanket after the metallic workpiece contacts the transfer blanket to receive the decoration formed by the digital print unit.

The control system is in communication with at least the digital print unit and the feed unit. Additionally, the control system may send a signal to the digital print unit to generate the decoration. In one embodiment, the control system may send a signal to the digital print unit to create a plurality of unique decorations. In response to receiving the signal, the digital print unit will transfer a decorating material to the transfer blanket to form the decoration on the transfer blanket. The decorating material may comprise one or more of a toner and an ink. The transfer blanket then transfers the decorating material to an exterior surface of the metallic workpiece. In this manner, the apparatus may decorate a plurality of metallic workpieces with unique decorations at a high rate of speed.

Optionally, the control system can send a signal to a digital print unit to alter a viscosity of an ink to be conveyed from the digital print unit. The control system can also send a signal to a temperature control device to change a temperature of the transfer blanket. In one embodiment, the control system can alter a position of a blanket support, such as by directing the blanket support to pivot with respect to the blanket wheel. The control system can also cause a blanket support to move such that a distance between a transfer blanket segment and the blanket wheel changes. In one embodiment, the control system can cause a blanket support to change its length. In another embodiment, the control system can send a signal which causes the blanket support to retract into, or extend from, the blanket wheel.

In one embodiment, the curing unit may at least partially cure the decorating material. In another embodiment, the curing unit at least partially cures the decorating material on the transfer blanket before the decoration is transferred to the metallic workpiece. Optionally, the apparatus may include a plurality of curing units. In one embodiment, a curing unit is associated with each of the digital print units. In another embodiment, the apparatus includes a single curing unit to cure, or at least partially cure, the decoration after the decoration is formed by one or more digital print units. Optionally, in another embodiment, the curing unit cures the decoration after the decoration is transferred from the transfer blanket to the exterior surface portion of the metallic workpiece. In one embodiment, the curing unit is operable to cure an ink. In another embodiment, the curing unit is operable to cure one or more of a UV curable ink with ultra-violet light, a water-based ink with thermal energy, and a mineral oil-based ink with thermal energy. In one embodiment, the curing unit is operable to cure a toner material comprising particles.

It is another aspect of the present invention to provide a method of decorating an exterior surface portion of a container. The method includes, but is not limited to: (1) providing a container; and (2) decorating the container with a decorator that includes: (a) a digital print unit; and (b) a transfer blanket in a predetermined alignment with respect to the digital print unit such that the transfer blanket receives a decorating material from the digital print unit. Accordingly, when an exterior surface portion of the container is brought into contact with the transfer blanket, at least some of the decorating material from the transfer blanket is transferred to the container to form the decoration on the exterior surface portion of the container. In one embodiment, the exterior surface portion of the container comprises one of a body portion of the container, a closed end portion of the container, an end closure for the container, a ROPP closure, and a crown cap. Optionally, the decorating material may be one or more of a toner and an ink.

In one embodiment, the digital print unit comprises one of an inkjet print head and an electrophotographic drum or plate. In another embodiment, the digital print unit is operable to jet a plurality of colors of ink to the transfer blanket. Alternatively, the digital print unit is operable to jet a single color of ink to the transfer blanket. In another embodiment, the digital print unit is operable to transfer toner to the transfer blanket. In one embodiment, the toner transferred by the digital print unit comprises a plurality of colors.

In one embodiment, a single digital print unit forms a complete decoration on the transfer blanket. In another embodiment, the digital print unit includes from two to ten digital print units. In one embodiment, each of the two to ten digital print units can form a portion of the decoration on the transfer blanket. In another embodiment, each of the two to ten digital print units can convey a different color of ink or a different image to the transfer blanket. In one embodiment, the two to ten digital print units comprise one or more of an inkjet print head and an electrophotographic drum.

In another embodiment, the transfer blanket comprises a plurality of individual transfer blanket segments. In this embodiment, the method can further include changing a position of a transfer blanket segment with respect to a blanket wheel. In one embodiment, the method includes changing a distance between a transfer blanket segment and the blanket wheel. In another embodiment, the method can include pivoting a blanket support and an associated transfer blanket segment with respect to the blanket wheel. Optionally, the method can further include altering a spacing between adjacent transfer blanket segments. In one embodiment, the adjacent transfer blanket segments have a first spacing proximate to the digital print unit and a second spacing at an image transfer position in which the container is brought into contact with the transfer blanket. Alternatively, in still another embodiment, the transfer blanket comprises a single continuous sheet or loop of material.

In one embodiment, the transfer blanket comprises one of a photopolymer material or a compound comprising at least in part a saturated chain of polymethylene. In another embodiment, the saturated chain of polymethylene of the transfer blanket comprises an ethylene propylene diene monomer rubber known to those of skill in the art as EPDM rubber. In still another embodiment, transfer blanket includes a face portion comprising a rubber material known as Nitrile butadiene rubber.

Optionally, the method can include altering a viscosity of ink associated with the digital print unit. In one embodiment, the method includes activating an initiator in the ink to alter the viscosity of the ink. In another embodiment, the method include one of heating and cooling the ink to alter the viscosity of the ink. Additionally, or alternatively, the method may further include adjusting a temperature of the transfer blanket.

In one embodiment of the present invention, the decorator optionally includes one or more of a feed unit, a control system, a curing unit, and a cleaning system. The feed unit is operable to move the container into a predetermined alignment with respect to the transfer blanket. In one embodiment, the feed unit receives the container from upstream equipment. The upstream equipment may include a surface treatment unit.

Optionally, the decorator may include a first feed unit and a second feed unit. In one embodiment, the method may further comprise: (a) forming a first decoration, a second decoration, and a third decoration on the transfer blanket with the digital print unit; (b) moving, by the first feed unit, a first container into contact with the transfer blanket such that the first decoration is transferred to the first container; (c) moving, by the second feed unit, a second container into contact with the transfer blanket such that the second decoration is transferred to the second container; and (d) moving, by the first feed unit, a third container into contact with the transfer blanket such that the third decoration is transferred to the third container. In one embodiment, the first, second, and third decorations are formed sequentially on the transfer blanket.

The cleaning system is in a predetermined orientation with respect to the transfer blanket. In one embodiment, the cleaning system is operable to remove residual decorating material from the transfer blanket after the container contacts the transfer blanket to receive the decoration formed by the digital print unit.

The control system is in communication with one or more of the digital print unit and the feed unit. Additionally, the control system may send a signal to the digital print unit to generate the decoration. In one embodiment, the control system may send a signal to the digital print unit to create a plurality of unique decorations that the digital print unit will form on the transfer blanket. In one embodiment, the decoration formed by the digital print unit comprises at least one of an ink and a toner. In this manner, the decorator may decorate a plurality of containers with unique decorations.

In one embodiment, the curing unit may at least partially cure the decoration on the transfer blanket before the decoration is transferred to the container. Alternatively, in another embodiment, the curing unit cures the decoration on the container. Optionally, the decorator may include a plurality of curing units. Optionally, the decorator may include a first digital print unit and a second digital print unit. The first digital print unit may transfer a first decorating material to one or more of the first, second, and third decorations. The second digital print unit may transfer a second decorating material to one or more of the first, second, and third decorations. In one embodiment, a curing unit is associated with each of the first and second digital print units. In another embodiment, the decorator includes a single curing unit to cure, or at least partially cure, the decoration after the decoration is formed by one or more digital print units. More specifically, in one embodiment, the curing unit is configured to cure the first, second, and third decorations after the first and second digital print units have transferred their respective first and second decorating materials to the transfer blanket. In one embodiment, the curer is configured to cure the first, second, and third decorations while the decorating material of the first and second digital print units is on the transfer blanket. Alternatively, in another embodiment, the curer is configured to cure the first, second, and third decorations after the decorating material is transferred from the transfer blanket to respective first, second, and third containers. In still another embodiment, the curing unit is operable to cure one or more of a toner, a UV curable ink, a water-based ink, and an oil-based ink such as a mineral oil ink.

Yet another aspect of the present invention is a container decorated by a decoration formed by an electrophotographic system on an intermediate substrate. The container includes, but is not limited to: (1) a bottom portion; (2) a body portion extending upwardly from the bottom portion, the body portion including an exterior surface portion; (3) an opening positioned on an uppermost portion of the body portion; and (4) a decoration on the exterior surface portion, the decoration comprising a digital image formed by a toner transferred to a transfer blanket by the electrophotographic system, wherein, when the exterior surface portion of the container rotates in contact with the transfer blanket, the toner on the transfer blanket is transferred to the exterior surface portion of the container. In one embodiment, the toner is cured after transfer to the exterior surface portion of the container.

In one embodiment, the decoration has a resolution of at least about 1600 by 1600 dots per inch. In another embodiment, the decoration comprises up to five colors of toner. In another embodiment, the container comprises a metallic container. In another embodiment, the container is one of a beverage container, an aerosol container, and a food container. In still another embodiment, the container is formed of one or more of an aluminum, a steel, a tin, a plastic, a paper, and a glass.

Yet another aspect of the present invention is a method of forming a decoration on an exterior surface portion of a first cylindrical container. The method includes one or more of, but is not limited to: (1) transferring a decorating material from a digital print unit to a transfer blanket of a decorator, the decorating material defining the decoration; (2) providing the first cylindrical container; (3) positioning the first cylindrical container in a feed unit of the decorator; and (4) moving the exterior surface portion of the first cylindrical container into contact with the transfer blanket. In this manner, the decorating material defining the decoration is transferred from the transfer blanket to the exterior surface portion of the first cylindrical container. In one embodiment, the decorating material comprises at least one of an ink and a toner material.

In one embodiment, the transfer blanket comprises a plurality of individual blanket segments. Optionally, the individual blanket segments are operable to match a rate of rotation of the first cylindrical container positioned in the feed unit. In another embodiment, the transfer blanket is a continuous loop of material.

In one embodiment, the decorator further comprises one or more of a cleaning system and a curing unit to at least partially cure the decorating material. The cleaning system is operable to remove residual decorating material from the transfer blanket. Optionally, the curing unit is operable to cure one or more of a toner material, a UV curable ink, a water-based ink, and a mineral oil-based ink.

In one embodiment, the curing unit is configured to at least partially cure the decorating material on the transfer blanket. Optionally, the curing unit can cure decorating material transferred to the transfer blanket from two or more digital print units. More specifically, in one embodiment, the curing unit can cure decorating material on the transfer blanket from two or more digital print units. Accordingly, in one embodiment, the curing unit is located downstream of all of the digital print units. In this manner, wet or uncured decorating material transferred to the transfer blanket by one or more of the digital print units is cured by a single curing unit. In one embodiment, a second decorating material is conveyed to the transfer blanket before a first decorating material on the transfer blanket is cured. In another embodiment, the curing unit is configured to cure the decorating material after the decorating material is transferred to the exterior surface portion of the first cylindrical container.

In one embodiment, the feed unit includes a plurality of mandrels operable to rotate. In one embodiment, the mandrels rotate such that the first cylindrical container spins at a rate substantially equal to a velocity of the transfer blanket.

Optionally, the feed unit of the decorator comprises at least a first feed unit and a second feed unit. In one embodiment, the digital print unit is configured to sequentially form a first decoration and a second decoration of decorating material on the transfer blanket. The first feed unit is aligned with respect to the transfer blanket to transfer the first decoration to the first cylindrical container. The second feed unit is aligned with respect to the transfer blanket to transfer the second decoration to a second cylindrical container. The first feed unit can be positioned to move cylindrical containers into contact with the transfer blanket at a first image transfer position. The second feed unit is positioned to move cylindrical containers into contact with the transfer blanket at a second image transfer position.

In another embodiment, the decorator includes a tensioning device in operable contact with the transfer blanket. Optionally, the method may further include adjusting, by the tensioning device, a tension of the transfer blanket.

In one embodiment, the digital print unit comprises an electrophotographic system. The method may further include charging a conductor of the electrophotographic system, exposing selected portions of the conductor to light to form a latent decoration, transferring a decorating material to the latent decoration, wherein the decorating material is a toner material, and transferring the decorating material from the conductor to the transfer blanket. In this manner, the electrophotographic system can form the decoration on the transfer blanket.

In another embodiment, a control system is in communication with the decorator. The method may further comprise: generating, by the control system, the decoration. Optionally, the method can include: sending a signal, by the control system, to the digital print unit, wherein the signal causes the digital print unit to transfer the decorating material to the transfer blanket. In another embodiment, the method can include: send a signaling, by the control system, to a temperature control device. The signal may cause the temperature control device to one or more of: (i) alter a temperature of an ink; and (ii) alter a temperature of the transfer blanket. In another embodiment, the method optionally includes: sending, by the control system, a signal to alter a viscosity of an ink. In one embodiment, the signal causes a light source to generate a light of a predetermine wavelength. The light activates an initiator in the ink. When activated, the initiator increases or decreases the viscosity of the ink. The light source may be positioned such that the light contacts the ink before the ink is transferred to the transfer blanket. In another embodiment, the light source is positioned to generate light which contacts the ink on the transfer blanket. In still another embodiment, the light source is positioned to generate light which strikes the ink as it is jetted from the inkjet print head and before the ink contacts the transfer blanket.

It is another aspect of the present invention to provide a decorator with two or more feed units. The feed units may be arranged such that alternating decorations formed on a transfer blanket are transferred to metallic containers supported by the feed units. In one embodiment, a first feed unit transfers every other decoration on the transfer blanket to metallic containers. More specifically, the first feed unit may cause a first decoration and a third decoration of sequential decorations on the transfer blanket to be transferred to metallic containers supported by the first feed unit. A second feed unit may cause a second decoration and a fourth decoration of the sequential decorations to be transferred to metallic containers supported by the second feed unit.

In another aspect, a decorator may include a transfer blanket with two or more blanket segments that are arranged edge to edge. Each blanket segment forms an endless loop. The blanket segments may be decorated by one or more digital print units. Subsequently, the blanket segments may move past two or more support elements. Each support element may move metallic containers into contact with decorating material on one of the blanket segments. In one embodiment, a decorator includes two blanket segments and two support elements. Each support element is associated with one of the two blanket segments. In this manner, the decorator can decorate metallic containers from two production runs. In another embodiment, the decorator includes four support elements and four blanket segments which are endless loops. Each support element is associated with one of the four blanket segments.

It is another aspect to provide a decorator with a blanket wheel that includes blanket supports extending therefrom. A transfer blanket segment is associated with each blanket support. In one embodiment, the blanket supports have a variable length. In this manner, the position of a transfer blanket segment positioned on a blanket support may vary as the blanket wheel rotates. In a first position, the transfer blanket segment may be a first distance from the blanket wheel. At a second position, the transfer blanket segment may be a second distance from the blanket wheel. In another embodiment, the blanket supports are pivotally interconnected to the blanket wheel. In still another embodiment, one or more of the blanket supports includes a joint. Accordingly, a blanket support may bend or move a transfer blanket segment interconnected thereto as the blanket wheel rotates.

Still another aspect of the present invention is a decorator with a curer configured to cure decorating material from at least two digital print units. The decorator includes, but is not limited to: (1) a first digital print unit configured to transfer a first decorating material to a transfer blanket of the decorator, the first decorating material forming at least a portion of a first decoration; (2) a second digital print unit configured to transfer a second decorating material to the transfer blanket, the second decorating material forming at least another portion of the first decoration; and (3) a curer to at least partially cure the first and second decorating materials. In one embodiment, the second digital print unit transfers the second decorating material to the transfer blanket proximate to the first decorating material before the first decorating material is cured by the curer. In one embodiment, the curer is positioned downstream from the second digital print unit. More specifically, in one embodiment, the curer is positioned between the second digital print unit and an image transfer position of the decorator.

In one embodiment, the curer is configured to cure the first and second decorating materials on the transfer blanket. In another embodiment, the curer is configured to cure the first and second decorating materials on an exterior surface of a cylindrical container.

Optionally, the first and second decorating materials are one of a toner and an ink. In one embodiment, the first digital print unit is one of an inkjet print head and an electrophotographic system. In another embodiment, second digital print unit is one of an inkjet print head and an electrophotographic system.

In one embodiment, the first and second digital print units comprise first and second inkjet print heads. The decorator is configured to alter viscosities of first and second inks of the respective first and second inkjet print heads. In one embodiment, the decorator includes a temperature control device configured to heat or cool the transfer blanket to a predetermined temperature. In another embodiment, the decorator includes a temperature control device configured to alter a temperature of the first and second inks supplied to the first and second inkjet print heads.

Additionally, or alternatively, the first and second inks may include initiators which are activated by a light of predetermined wavelengths. When activated, a first initiator can increase a viscosity of an ink. A second initiator can decease a viscosity of an ink when the second initiator is activated. The decorator can include light sources associated with the first and second inkjet print heads. A first light source can generate light of one or more predetermined wavelengths to selectively activate at least one of the first and second initiators in the first ink. A second light source can be associated with the second inkjet print head to selectively activate the first and second initiators in the second ink.

One aspect of the present invention is an apparatus for applying decorations to exterior surfaces of metallic containers. The apparatus includes, but is not limited to: (1) a transfer blanket; (2) a digital print unit in a predetermined alignment with respect to the transfer blanket, the digital print unit operable to convey a decorating material to the transfer blanket to form at least a portion of a first decoration and a second decoration on the transfer blanket; (3) a first feed unit to move a first metallic container into contact with the transfer blanket to transfer the first decoration from the transfer blanket to an exterior surface of the first metallic container; and (4) a second feed unit to move a second metallic container into contact with the transfer blanket to transfer the second decoration from the transfer blanket to an exterior surface of the second metallic container. The decorating material includes a least one of an ink and a toner material. In one embodiment, the transfer blanket is a continuous loop of material. Alternatively, the transfer blanket comprises a plurality of individual blanket segments. The first feed unit may be aligned with a first image transfer position of the apparatus and the second feed unit may be aligned with a second image transfer position of the apparatus.

In one embodiment, the apparatus comprises a plurality of digital print units. Each of the digital print unit is operable to convey one or more of a different color of decorating material and a different decoration to the transfer blanket.

Optionally, the apparatus includes a curing unit positioned downstream from the plurality of digital print units. In one embodiment, the curing unit is configured to cure the decorating material conveyed by the plurality of digital print units to the transfer blanket. In another embodiment, the curing unit is operable to cure decorating material on an exterior surface of a metallic container.

In one embodiment, the apparatus includes a temperature control device operable to adjust a temperature of the transfer blanket. Optionally, a viscosity of the decorating material is altered when the temperature control device adjusts the temperature of the transfer blanket.

In one embodiment, the digital print unit is an electrophotographic system comprising a conductor, a charging element, an exposure element, and a developer unit which supplies the decorating material. In another embodiment, digital print unit is an inkjet print head and the decorating material is an ink. The apparatus may further include one or more of a thermal system and a UV system configured to adjust a viscosity of the ink.

Another aspect of the present invention is a method of forming a decoration on an exterior surface portion of a cylindrical container. The method generally includes one or more of, but is not limited to: (1) transferring a decorating material from at least two digital print units to a transfer blanket of a decorator such that the decorating material forms a decoration on the transfer blanket; (2) curing the decoration on the transfer blanket with a curing unit; (3) providing the cylindrical container; (4) positioning the cylindrical container in a feed unit of the decorator; and (5) moving the exterior surface portion of the cylindrical container into contact with the transfer blanket, wherein the decoration is transferred from the transfer blanket to the exterior surface portion of the cylindrical container. The decorating material may comprise at least one of an ink and a toner material. Optionally, the transfer blanket comprises one of a plurality of individual blanket segments and a continuous loop of material.

The method may further include pivoting a transfer blanket segment with respect to a blanket wheel of the decorator. Additionally, or alternatively, the method may include altering a distance between a transfer blanket segment and the blanket wheel.

In one embodiment, the method includes one or more of: (i) transferring more of the decorating material from the at least two digital print units to the transfer blanket to form a second decoration on the transfer blanket; (ii) providing a second cylindrical container; (iii) positioning the second cylindrical container in a second feed unit of the decorator; and (iv) moving an exterior surface portion of the second cylindrical container into contact with the transfer blanket at a position downstream from the feed unit, wherein the second decoration is transferred to the exterior surface portion of the second cylindrical container.

The curing unit may be positioned downstream from the at least two digital print units. Optionally, the curing unit is operable to cure one or more of a toner material, a UV curable ink, a water-based ink, and a mineral oil-based ink.

In one embodiment, transferring the decorating material from the at least two digital print units further comprises one or more of: (a) charging a conductor of a first of the at least two digital print units, wherein the first digital print unit is an electrophotographic system; (b) exposing selected portions of the conductor to light to form a latent decoration; (c) transferring the decorating material to the latent decoration, wherein the decorating material is a toner material; and (d) transferring the decorating material from the conductor to the transfer blanket.

In another embodiment, the method further comprises: (1) transferring the decorating material from the conductor to the transfer blanket; (2) sending a signal, by the control system, to the at least two digital print units, wherein the signal causes the at least two digital print units to transfer the decorating material to the transfer blanket.

The method may further comprise heating the transfer blanket to a predetermined temperature. Additionally, or alternatively, the method can include adjusting a viscosity of the decorating material supplied to at least one of the at least two digital print units, wherein the decorating material is an ink. In one embodiment, adjusting a viscosity of the ink includes one of heating or cooling the ink. In another embodiment, adjusting a viscosity of the ink includes activating an initiator in the ink. Activating the initiator may include exposing the initiator to light of a predetermined wavelength.

It is still another aspect of the present disclosure to provide a decorator for decorating metallic containers. The decorator generally includes, but is not limited to: (1) a blanket wheel operable to rotate; (2) spokes extending generally radially from the blanket wheel, each spoke having a distal end spaced from the blanket wheel; (3) a transfer blanket segment interconnected to a distal end of each spoke; (4) a digital print unit configured to convey a decorating material to the transfer blanket segments as the blanket wheel rotates the spokes past the digital print unit, the decorating material forming to form a decoration on each transfer blanket segment; and (5) a feed unit to move a metallic container into contact with a transfer blanket segment to transfer the decoration to an exterior surface of the metallic container. Optionally, a distance between the blanket wheel and the transfer blanket segments at the distal end of each of the spokes is adjustable.

In one embodiment, a length of each spoke is adjustable. In another embodiment, each spoke can be retracted at least partially into the blanket wheel. Additionally, or alternatively, the spokes can pivot relative to the blanket wheel.

In another embodiment, each spoke includes a first section interconnected to the blanket wheel and a second section including the distal end, wherein the first section is pivotally interconnected to the second section.

In one embodiment, the distal ends of the spokes are moveable with respect to the blanket wheel. Accordingly, a first transfer blanket segment interconnected to a first spoke and a second transfer blanket segment interconnected to a second spoke are separated by a first distance proximate to the digital print unit. As the blanket wheel rotates, the distal ends of the spoke move such that the first and second transfer blanket segments are separated by a second distance proximate to the feed unit.

Although generally referred to herein as "metallic container," "beverage container," "can," and "container," it should be appreciated that the current invention may be used to decorate containers of any size or shape including, without limitation, beverage cans, beverage bottles, a can for a food product, and aerosol containers. Accordingly, the term "container" is intended to cover containers of any type for any product and is not specifically limited to a beverage container such as a soft drink or beer can. The containers may also be in any state of manufacture. Further, the container may be formed by a draw and ironing process or by an impact extrusion process. Thus, the current invention may be used to decorate "a cup" that is subsequently formed into a finished container, a "bottle preform" that is subsequently formed into a metallic bottle, or a "tube" that is formed into an aerosol container body. Further, the current invention may be used to decorate any portion of a container. For example, in one embodiment of the present invention, the decorator may be used to decorate an exterior surface portion of a container, including one or more of a closed end portion and an exterior surface portion of a body portion of the container. In another embodiment of the present invention, the decorator may decorate an exterior surface portion of an end closure which is adapted for interconnection to a neck of a container. In yet another embodiment, an exterior surface of a ROPP closure adapted for interconnection to a threaded neck of a container may be decorated by the decorator of the present invention. In still another embodiment, the decorating material may be transferred to an exterior surface portion of a crown cap that is adapted for interconnection to a neck of a container.

The terms "metal" or "metallic" as used hereinto refer to any metallic material that may be used to form a container, including without limitation aluminum, steel, tin, and any combination thereof. However, it will be appreciated that the apparatus and method of the present invention may be used to decorate containers formed of any material, including paper, plastic, and glass. In addition, although the methods and apparatus of the present invention are generally described in conjunction with decorating metallic containers with a generally cylindrical body, it will be appreciated that the methods and apparatus of the present invention may be used to decorate substrates of any type, including a continuous web or sheet of metal, plastic, or paper.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the Summary of the Invention, Brief Description of the Drawings, Detailed Description, Abstract, and Claims themselves.

The Summary of the Invention is neither intended, nor should it be construed, as being representative of the full extent and scope of the present invention. Moreover, references made herein to "the present invention" or aspects thereof should be understood to mean certain embodiments of the present invention and should not necessarily be construed as limiting all embodiments to a particular description. As will be appreciated, other embodiments are possible using, alone or in combination, one or more of the features set forth above or described below. For example, it is contemplated that various features and devices shown and/or described with respect to one embodiment or figure may be combined with or substituted for features or devices of other embodiments or figures regardless of whether or not such a combination or substitution is specifically shown or described herein. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the invention and together with the Summary of the Invention given above and the Detailed Description given below serve to explain the principles of these embodiments. In certain instances, details that are not necessary for an understanding of the disclosure or that render other details difficult to perceive may have been omitted. It should be understood, of course, that the present invention is not necessarily limited to the particular embodiments illustrated herein. Additionally, it should be understood that the drawings are not necessarily to scale.

Figure 1:
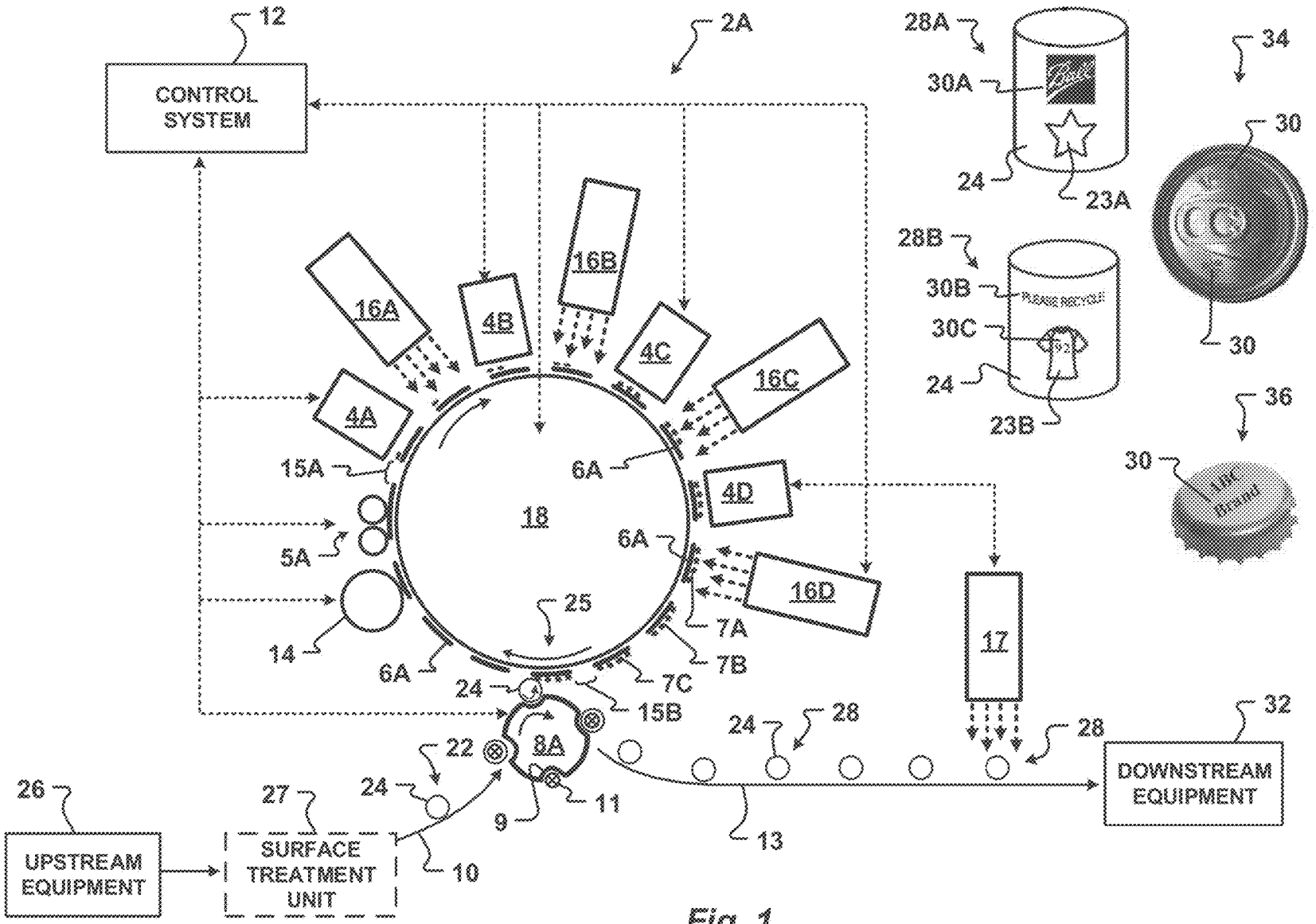
FIG. 1 is a schematic flow diagram of a decorator depicting one embodiment of the present invention and also illustrating a metallic container, an end closure, and a crown cap decorated by a decorator of the present invention.

Similar components and/or features may have the same reference number. Components of the same type may be distinguished by a letter following the reference number. If only the reference number is used, the description is applicable to any one of the similar components having the same reference number.

To assist in the understanding of the present invention the following list of components and associated numbering found in the drawings is provided herein:

| Number | Component |
|---|---|
| 2 | Decorator |
| 4 | Digital print unit |
| 5 | Temperature control device |
| 6 | Transfer blanket |
| 6A | Transfer blanket segments |
| 6B | Continuous transfer blanket |
| 6C | Continuous transfer blanket |
| 7 | Decoration on blanket |
| 8 | Feed unit |
| 9 | Stations |
| 10 | Conveyor |
| 11 | Mandrels |
| 12 | Control system |
| 13 | Conveyor |
| 14 | Cleaning system |
| 15 | Distance between adjacent transfer blanket segments |
| 16 | Curing unit |
| 17 | Curing unit |
| 18 | Blanket wheel |
| 20 | Blanket support |
| 21 | Distance between the blanket wheel and a blanket segment |
| 22 | Metallic container |
| 23 | First decoration |
| 24 | Exterior surface of metallic container |
| 25 | Image transfer position |
| 26 | Upstream equipment |
| 27 | Surface treatment unit |
| 28 | Decorated metallic container |
| 29 | Pivot joint |
| 30 | Decorations on metallic containers |
| 31 | Second pivot joint |
| 32 | Downstream equipment |
| 33 | Third pivot joint |
| 34 | End closure |
| 36 | Crown cap |
| 37 | First section of a blanket support |
| 38 | Second section of a blanket support |
| 39 | Third section of a blanket support |
| 40 | Electrophotographic system |
| 41 | Inkjet print head |
| 42 | Conductor |
| 43 | Ink |
| 44 | Charging element |
| 45 | Nozzle |
| 46 | Exposure element |
| 47 | Light emitter |
| 48 | Developer unit |
| 49 | Roller |
| 50 | Transfer charging element |
| 51 | Ink source |

-continued

| Number | Component |
|---|---|
| 52 | Toner |
| 53 | Aperture |
| 54 | Inside idler |
| 55 | Light |
| 56 | Backside idler |
| 58 | Shoe tensioner |
| 60 | Rotary tensioner |
| 61 | Rollers of dual-roller tensioner |
| 62 | Impression roller |
| 63 | Linkage |
| 64 | Servo drive |
| 65 | Blanket width |
| 66 | Transfer blanket segment |
| 67 | Longitudinal edge of a blanket segment |
| 68 | Bus |
| 70 | CPU |
| 72 | Input devices |
| 74 | Output devices |
| 76 | Storage devices |
| 78 | Computer readable storage media reader |
| 80 | Communication system |
| 82 | Working memory |
| 84 | Optional processing acceleration |
| 86 | Database |
| 88 | Network |
| 90 | Database |
| 92 | Operating system |
| 94 | Other code |

DETAILED DESCRIPTION

The present invention has significant benefits across a broad spectrum of endeavors. It is the Applicant's intent that this specification and the claims appended hereto be accorded a breadth in keeping with the scope and spirit of the invention being disclosed despite what might appear to be limiting language imposed by the requirements of referring to the specific examples disclosed. To acquaint persons skilled in the pertinent arts most closely related to the present invention, a preferred embodiment that illustrates the best mode now contemplated for putting the invention into practice is described herein by, and with reference to, the annexed drawings that form a part of the specification. The exemplary embodiment is described in detail without attempting to describe all of the various forms and modifications in which the invention might be embodied. As such, the embodiments described herein are illustrative and, as will become apparent to those skilled in the arts, may be modified in numerous ways within the scope and spirit of the invention.

Referring now to FIG. 1, a schematic flow diagram of a decorator 2 of the present invention is illustrated. The decorator 2 generally comprises at least one digital print unit 4, a transfer blanket 6, a feed unit 8, conveyors 10, 13, and a control system 12. In one embodiment, the transfer blanket 6 comprises a plurality of transfer blanket segments 6A. The decorator 2 may optionally include one or more of a cleaning system 14 and a curing or drying unit 16, 17. Optionally, the decorator 2 can include at least one temperature control device 5.

Digital print units 4 are in a predetermined alignment with respect to the transfer blanket 6. The digital print units 4 form decorations 7 on the transfer blanket 6. In one embodiment, the decorator 2 includes from one to four digital print units 4A, 4B, 4C, 4D. However, it will be appreciated that any number of digital print units 4 may be used with decorators 2 of embodiments of the present invention. For example, in one embodiment, the decorator 2 includes from one to ten different digital print units 4.

In one embodiment, a digital print unit 4 contacts the transfer blanket 6 to form an indicia or a decoration 7 on the transfer blanket 6. Alternatively, in another embodiment, the digital print units 4 do not contact the transfer blanket 6, but rather apply the indicia or decoration 7 to the transfer blanket without contact. In one embodiment, a digital print unit 4 can form a decoration with a resolution of at least 1600 by 1600 dots per inch. Thus, decorations 7 formed on the transfer blanket 6 are considered to be high-definition images.

Figure 2A:
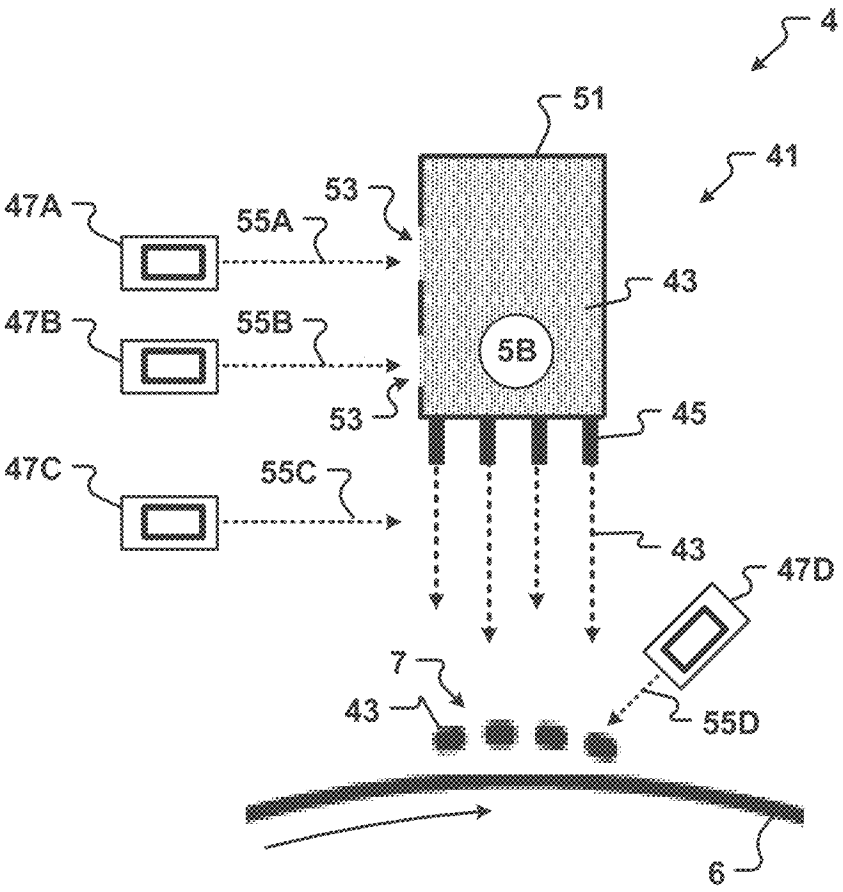
FIG. 2A is a schematic diagram of a digital print unit comprising an inkjet print head according to one embodiment of the present invention.

In one embodiment, digital print units 4 form decorations 7 on the transfer blanket 6 by spraying, jetting, or otherwise conveying ink to the transfer blanket 6. In one embodiment, one or more of the digital print units 4 comprise an inkjet printer or an inkjet print head 41 (such as illustrated in FIG. 2A). In another embodiment, the digital print units 4 form a decoration 7 on the transfer blanket 6 by transferring toner to the transfer blanket. More specifically, in one embodiment, a digital print unit 4 includes an electrophotographic system 40 (generally illustrated in FIG. 2B) which transfers a toner material 52 to the transfer blanket. One of the digital print units 4 may be an inkjet printer and another one of the digital print units 4 be an electrophotographic system 40. The order and relative positions of the digital print units 4 with respect to the blanket wheel 18 may be varied.

In one embodiment, each of the digital print units 4A, 4B, 4C, 4D conveys a decorating material of a single color or type to the transfer blanket 6. In this manner, the first digital print unit 4A conveys a first decorating material to the transfer blanket 6. Similarly, the second digital print unit 4B conveys a second decorating material, the third digital print unit 4C conveys a third decorating material, and the fourth digital print unit 4D conveys a fourth decorating material to the transfer blanket 6. The decorating material conveyed by each of the digital print units is one of an ink and a toner. A decoration 7 formed on the transfer blanket 6 may comprise one or more of the first, second, third, and fourth inks and/or toners. The decorating material from each digital print unit 4 may be applied to different portions of the transfer blanket 6 to form a single decoration 7. Additionally, decorating material from two or more of the digital print units 4 may at least partially overlap or overlay each other to form a decoration 7.

Alternatively, in another embodiment, two or more of the digital print units 4 may convey the same color of decorating material to the transfer blanket 6. A first digital print unit 4A may form a portion of a decoration 7 in a first color. A second digital print unit 4B may form a second portion of the decoration 7 in one or more of the first color and a second color. In one embodiment, by dividing formation of the decoration 7 between two digital print units 4A, 4B, the decorator 2 of the present invention may operate at a faster rate compared to a decorator with a single digital print unit used to form a decoration. More specifically, the transfer blanket 6 may move past digital print units 4A, 4B at a faster rate than if one digital print unit 6 were used to form the entire decoration 7.

In another embodiment, one or more of the digital print units 4 is operable to transfer a plurality of colors or types of decorating material to the transfer blanket 6. For example, in one embodiment, at least one of the digital print units 4 can transfer decorating material of at least one of a cyan color, a magenta color, a yellow color, and a black (or "key") color to the transfer blanket 6 to form a decoration 7.

In one embodiment, each digital print unit 4 forms a complete decoration 7 on the transfer blanket 6. In another embodiment, each digital print unit 4 forms a portion of a decoration 7 on the transfer blanket 6. Accordingly, the first digital print unit 4A conveys decorating material to the transfer blanket 6 to form a first portion of a decoration 7. The second digital print unit 4B conveys additional decorating material to the transfer blanket 6 to form a second portion of the decoration 7. The third and fourth digital print units 4C, 4D can form third and fourth portions of the decoration 7. Each portion of the decoration 7 may comprise one or more colors or types of decorating material.

Referring now to FIG. 2A, in one embodiment, at least one of the digital print units 4 is an inkjet print head 41. The inkjet print head 41 generally includes a source 51 of ink 43 and nozzles 45. The nozzles 45 are operable to spray or jet the ink 43 to the transfer blanket 6. In one embodiment, the inkjet print head 41 can fire up to approximately 774 million drops of ink 43 per second. In still another embodiment, the inkjet print head 41 includes five color channels. In yet another embodiment, the inkjet print head 41 includes 10 rows of nozzles 45 with up to 70,400 nozzles per row for printing five colors of ink 43 at up to 1,600 dots per inch.

Any suitable ink 43 may be used with the inkjet print head 41 of the present invention. In one embodiment, the inkjet print head 41 can use an ink with nano-particles to form a predetermine image or indicia on an exterior surface 24 of a metallic container 22. In another embodiment, the inkjet print head 41 may use an ink 43 with a particle size of no greater than approximately 500 nm. In one embodiment, the ink 43 comprises a light-curable ink, such as, but not limited to, an ultra-violet (UV) curable ink. In another embodiment, the ink 43 comprises a water-based ink that is curable with thermal energy. In still another embodiment, the ink 43 comprises an oil-based ink which is cured by thermal energy. In one embodiment, the oil-based ink comprises a mineral oil ink.

Optionally, the inkjet print head 41 is configured to alter a viscosity of the ink 43. More specifically, the inkjet print head 41 can adjust the viscosity of the ink 43 by one or more of altering a temperature of the ink 43 and activating initiators in the ink 43. In one embodiment, altering or adjusting the viscosity of the ink 43 changes the size of dots or droplets of the ink 43 forming a decoration 7 on the transfer blanket 6. In this manner, inks from different inkjet print heads 41 can be conveyed to the transfer blanket 6 in proximity to each other to form the decoration 7 while the inks are wet or uncured. Additionally, or alternatively, altering the viscosity of the ink 43 prevents unintended or inadvertent movement of dots or drops of the ink 43 on the transfer blanket 6. Accordingly, multiple inks from different inkjet print heads 41 can be conveyed to the transfer blanket 6 without being cured before additional inks are conveyed to the transfer blanket. By adjusting the viscosity of the ink, the inkjet print head 41 can "pre-pin" the ink 43 to the transfer blanket. More specifically, in one embodiment, the viscosity of the ink can be adjusted to partially cure or dry the ink before or after contact with the transfer blanket 6.

The inkjet print head 41 can include a temperature control device 5B configured to heat or cool the ink 43. Optionally, the temperature control device 5B can be in contact with, or immersed in the ink 43. In another embodiment, the temperature control device 5B can be configured to heat or cool the ink source 51. For example, in one embodiment, the ink source 51 is a container or a hose. The temperature control device may be configured to heat or cool an exterior surface of the ink source 51 such that ink 43 within the ink source 51 is heated or cooled to a predetermined temperature.

In one embodiment, at least one light emitter 47 is associated with the inkjet print head 41. The light emitter 47 is operable to emit light 55. The light 55 is of a predetermined wavelength selected to activate one or more initiators in the ink 43. When activated by contact with the light 55, the initiators alter a viscosity of the ink 43. In one embodiment, the light 55 is a UV light.

In one embodiment, the ink 43 includes at least two initiators. A first initiator can increase the viscosity of the ink 43 when activated by light 55A of a first wavelength emitted by a first light emitter 47A. Additionally, or alternatively, the ink 43 may include a second initiator. The second initiator can decrease the viscosity of the ink 43 when activated by light 55B of a second wavelength emitted by a second light emitter 47B.

In one embodiment, the ink source 51 comprises a container or a hose that is transparent or translucent to the light 55. Optionally, at least a portion of the ink source 51 is transparent or translucent to light 55 generated by the light emitter 47. Alternatively, the ink source 51 can include a window or an aperture 53. The windows 53 can be selected to transmit light 55 from the light emitters. A light emitter can be aligned with an aperture 53 such that light 55 can enter the ink source 51 and illuminate the ink 43 and activate the viscosity initiators therein.

Optionally, a light emitter 47C can be oriented to direct light 55C which illuminates droplets of ink 43 emitted from the nozzles 45. The light 55C can be oriented to illuminate the ink droplets 43 before the ink reaches the transfer blanket 6. In this manner, the light emitter 47C can alter the viscosity of droplets of the ink 43 before the ink contacts the transfer blanket.

Additionally, or alternatively, in one embodiment a light emitter 47D is oriented to direct light 55D toward the transfer blanket 6. The light 55D can be of a predetermined wavelength to activate initiators in the ink 43 when the ink is positioned on the transfer blanket 6. Accordingly, the light emitter 47D is configured to alter the viscosity of the ink positioned on the transfer blanket.

In one embodiment, at least one of the digital print units 4 comprises an inkjet print unit 41. Suitable the inkjet print heads 41 may be obtained from a varied of suppliers including, but not limited to, Xaar, Konica Minolta, FujiFilm, Kyocera, Tonejet, and Memjet ink.

Figure 2B:
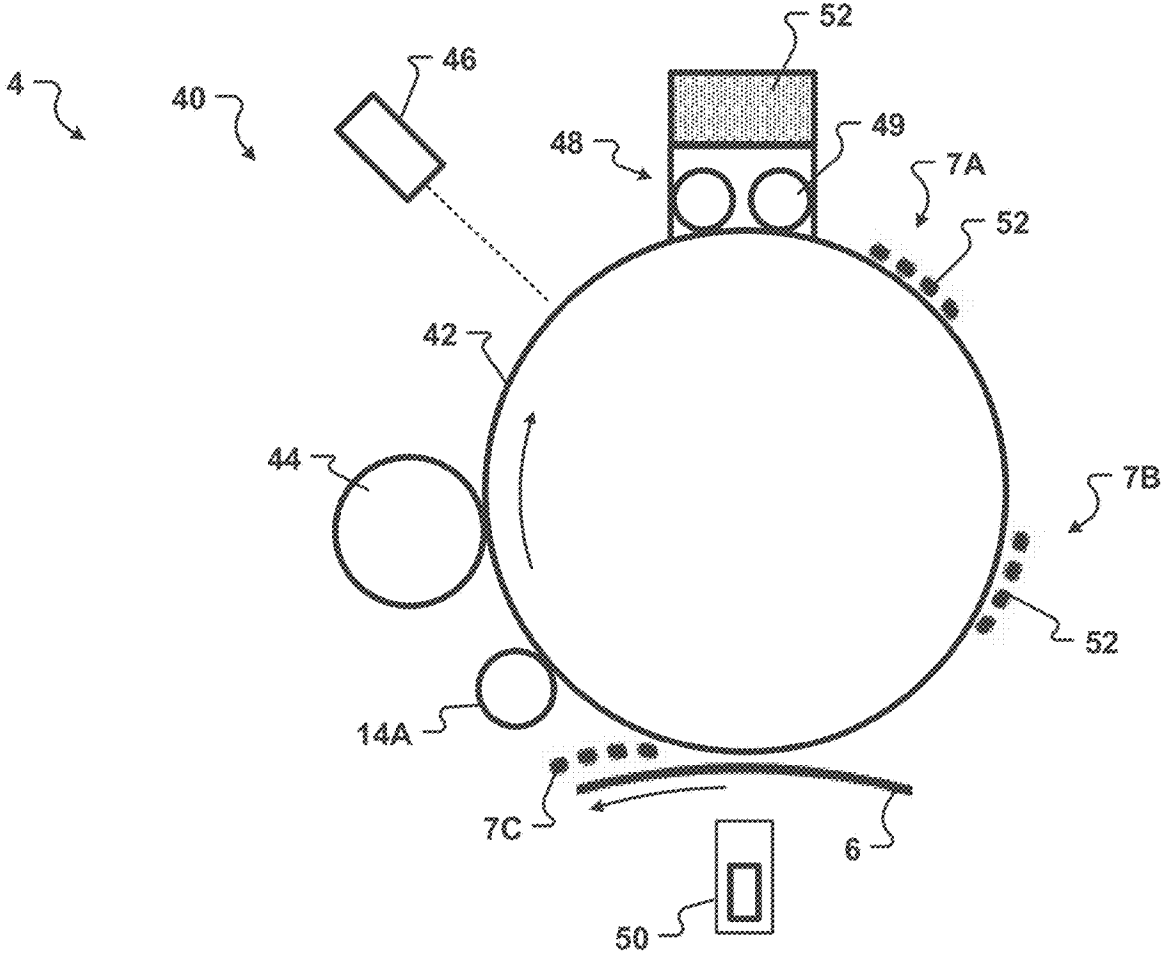
FIG. 2B is a schematic diagram of a digital print unit of one embodiment of the present invention which includes a electrophotographic system to form decorations which are transferred to a transfer blanket of a decorator.

Referring now to FIG. 2B, in one embodiment, one or more of the digital print units 4 may comprise an electrophotographic system 40. The electrophotographic system 40 may generally include one or more of a conductor 42 (also referred to as an "electrophotographic plate"), an "emitter" or charging element 44, an exposure element 46, and a developer unit 48. In one embodiment, the electrophotographic system 40 further includes one or more of a cleaning element 14A and a transfer charging element 50. Electrophotographic systems and toners used therewith are generally described in U.S. Pat. App. Pub. No. 2006/0068313, U.S. Pat. Nos. 4,743,926, 5,018,640, 5,065,183, 5,750,303, 6,818,369, 7,666,564, and 7,939,235 which are each incorporated herein by reference in their entirety.

The conductor 42 is positioned in a predetermined alignment with respect to the path of a transfer blanket 6 of a decorator 2. In one embodiment, the conductor 42 rotates in contact with an exterior surface of the transfer blanket 6. Alternatively, in another embodiment, the conductor 42 rotates in close proximity to the blanket exterior surface without contacting the transfer blanket 6. Regardless, the conductor 42 is oriented to transfer toner 52 to the transfer blanket 6. In one embodiment, the conductor 42 has a shape that is generally cylindrical. In another embodiment, the conductor 42 has a shape of a loop or a belt which may be circular or have a serpentine shape. The loop of the conductor 42 may extend around one or more rollers and tensioners.

In one embodiment, the conductor 42 includes a material that is photoconductive. More specifically, in one embodiment, a surface of the conductor 42 is conductive when exposed to light. The surface is non-conductive is the absence of light. Suitable photoconductive materials are known to those of skill in the art. In one embodiment, the conductor 42 comprises one or more layers of an inorganic material. The inorganic photoconductive material may include at least one of: silicon, selenium, cadmium sulfide, zinc oxide, and the like. In another embodiment, the conductor 42 includes at least one layer of an organic material. Optionally, the organic photoconductive material comprises one or more of polyvinyl carbazole, phthalocyanine, and the like.

In operation, the charging element 44 or "emitter" provides an electrical charge to the conductor 42. In one embodiment, the charging element 44 produces a corona discharge to electrically charge the conductor 42. Decorations are subsequently formed on the exterior surface of the conductor 42. In one embodiment, the charging element 44 has a generally cylindrical shape. In another embodiment, the charging element 44 contacts the conductor 42 as the charging element electrically charges the conductor.

Forming the decoration includes exposing selected portions of the conductor to light. More specifically, the exposure element 46 selectively exposes portions of the conductor 42 to light. The exposure element 46 can guide the light to selectively strike predetermined portions of the exterior surface of the conductor 42 to trace the shape of the decoration. The portions of the conductor 42 exposed to light by the exposure element 46 become neutralized as the charge provided by the charging element 44 is drained away by the conductive surface of the conductor. Other portions of the conductor 42 that are not exposed to light remain charged. The remaining charged areas of the conductor 42 form a latent decoration on the conductor 42. Accordingly, the exposure element 46 can discharge selected portions of the conductor 42. In one embodiment, the latent decoration is electrostatic.

In one embodiment, the decoration formed by the exposure element 46 is received from a control system 12 of the decorator 2. More specifically, in one embodiment, the control system 12 sends a signal to the exposure element 46. The signal causes the exposure element 46 to expose predetermined portions of the conductor 42 to form a latent decoration. In another embodiment, the exposure element 46 comprises a laser or other device that generates light.

The developer unit 48 converts the latent decoration to a decoration 7 that is visible. In one embodiment, the developer unit 48 includes a toner 52. The toner 52 is attracted to the charged areas of the latent decoration formed by the exposure element 46. In this manner, the toner 52 forms a decoration 7 which is visible on the conductor 42. Optionally, the developer unit 48 includes a roller 49 which transports the toner 52 to the conductor 42. In another embodiment, the developer unit 48 includes a blade to regulate the amount or thickness of toner 52 on the roller 49. Optionally, the toner 52 on the roller 49 is limited to a thickness of not greater than about 0.3 mm by the blade.

In one embodiment, the toner 52 comprises charged particles that adhere to the latent decoration. In one embodiment, the toner 52 may be electrically charged. In another embodiment, the toner 52 has an electric charge with a polarity that is the opposite of the polarity of the electrical charge of the conductor 42 created by the charging element 44. Optionally, the developer unit 48 may use a liquid toner or a dry toner to develop the decoration. In one embodiment, the dry toner uses only the toner 52. In another embodiment, the dry toner includes a carrier which transports the toner to the conductor 42. In one embodiment, the carrier comprises particles. The carrier particles may be larger than particles of the toner 52.

The carrier for the toner 52 may comprise one or more of iron powder, ferrite, magnetite and glass beads. These carriers can be coated with a resin. The resin can include, but is not limited to, polycarbon fluorides, polyvinyl chlorides, polyvinylidene chloride, phenol resins, polyvinyl acetal, and silicone resins. In one embodiment, the mixture ratio of toner to carrier is between about 1.5 to about 10.0 parts by weight of toner 52 to 100 parts by weight of carrier. In one embodiment, the carrier particles are magnetic.

The toner material 52 may include particles of one or more materials. In one embodiment, the toner includes a carbon powder and an iron oxide. In another embodiment, the toner material 52 includes at least one of a binder resin, a colorant, a polar resin, and a release agent. In one embodiment, the content of each color is typically from about 0.1 to 50 parts by weight based on 100 parts by weight of a binder resin. Optionally, the toner material 52 may include a polymer such as, but not limited to, a styrene acrylate copolymer, a polyester resin, and a styrene butadiene copolymer.

In one embodiment, an external additive is added to the toner 52. The external additive may include at least one of inorganic or organic particulates. The external additives can be subject to a surface treatment to improve hydrophobic property and prevent deterioration of the fluidity and charging properties of a toner 52 in a high humidity environment. Specific preferred examples of the surface treatment agents include, but are not limited to, coupling agents such as silane coupling agents, titanate coupling agents and aluminum coupling agents; silicone oil; higher aliphatic acids; and fluorine compounds.

The inorganic particles of the external additive may include metal oxides, metal carbides, metal nitrides, and metal carbonates. In one embodiment, the inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. The external additive may comprise organic particulates such as, but not limited to, one or more of copolymers of styrene, esters of methacrylic acid, and esters of acrylic acid, which can be prepared by a soap-free emulsion polymerization method, a suspension polymerization method or a dispersion polymerization method, and polycondensation thermosetting resins, for example, silicone resins, benzoguanamine resins and nylon.

A charge control agent may be included as a component of the toner material 52 of the present invention. The charge control agent may include known charge control agents. For example, the charge control agent may comprise one or more of: Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphorous and compounds including phosphorous, tungsten and compounds including tungsten, fluorine-containing activators, metal salts of salicylic acid, metal salts of salicylic acid derivatives, etc. In one embodiment, the content of the charge control agent is preferably from about 0.1 to 10 parts by weight, and more preferably from about 0.5 to 3 parts by weight based on 100 parts by weight of the binder resin. The charge control agents described above may be used alone or any combination in the toner material 52. Additionally, the amount of the charge control agent used may vary depending on the color of the toner material 52.

The toner material 52 may be formed of particles of a plurality of sizes. In one embodiment, an average size of toner particles is less than about 16 micrometers. In another embodiment, the average size of the toner particles is less than about 10 micrometers. Optionally, the particle size of the toner 52 is between about 6 micrometers and about 18 micrometers.

In one embodiment, an electrophotographic system 40 may transfer one or more colors of toner material 52 to the transfer blanket 6. For example, in one embodiment, an electrophotographic system 40 may transfer from one to four colors of toner material 52. In one embodiment, the toner material 52 comprises one or more of a cyan colorant, a magenta colorant, a yellow colorant, and a black colorant. Optionally, each color of toner material 52 has a different polarity. More specifically, a first toner may have a first polarity, a second toner may have a second polarity, a third toner may have a third polarity, and a fourth toner may have a fourth polarity. In this manner, an electrophotographic system 40 may form a decoration 7 comprising a plurality of different colors of toner material 52.

As the conductor 42 rotates proximate with the transfer blanket 6, the toner 52 is transferred from the conductor to the transfer blanket. In one embodiment, an optional transfer charging element 50 generates a charge that attracts the toner 52 from the conductor 42 to the transfer blanket 6. In one embodiment, the transfer charging element 50 generates a corona discharge to attract the toner 52. The toner 52 forms a decoration 7 on the blanket 6. The decoration 7 may subsequently be transferred to a container exterior surface 24 as described herein.

Optionally, the conductor 42 is subsequently cleaned by a cleaning system 14A. More specifically, the cleaning system 14A removes any particles of the toner 52 that were not transferred to the blanket 6. In one embodiment, the cleaning system 14A has a shape that is generally cylindrical. Additionally, in one embodiment, the cleaning system 14A may also discharge the conductor 42. For example, in one embodiment the cleaning system 14A generates light to expose an entire width of the conductor 42 to light. Thus, any remaining charge of the conductor 42 is discharged by the cleaning system 14A such that the conductor 42 may subsequently receive a new charge by the charging element 44.

Returning again to FIG. 1, the decorations 7 formed by the digital print units 4 may include any combination of letters, numbers, symbols, and images arranged in any order or orientation and of any size. The decorations are formed of a decorating material (such as ink or toner) and may be of a single color or formed of a plurality of colors. Additionally, each decoration may be unique. For example, decoration 7A may be different compared to one or more of decorations 7B, 7C. Thus, with a decorator 2 of the present invention, it is economically feasible to produce small batches of decorated metallic containers 28 with different images 30 thereon.

The transfer blanket 6 of the decorator 2 may be of any size or shape. In one embodiment of the present invention, illustrated in FIG. 1, the transfer blanket 6 comprises a plurality of individual transfer blanket segments 6A interconnected to a support element, such as a blanket wheel 18. However, in another embodiment, a single blanket 6 may be positioned on the blanket wheel 18. In another embodiment, the transfer blanket 6 may comprise a single sleeve or cylinder that wraps around a circumference of the blanket wheel 18. Additionally, the decorator 2 may use a continuous transfer blanket that is not circular. Optionally, each transfer blanket segment 6A has a length which is not less than a circumference of a metallic container 22.

The transfer blankets 6 of embodiments of the present invention may be formed of a material selected to receive and retain decorating material from the digital print units 4. In one embodiment, the transfer blankets 6 comprise one or more of a face portion, a first fabric layer, a compressible layer, and a second fabric layer as described in "Blanket for Offset Printing," (hereinafter "Offset Printing"), available at http://www.offsetprintingtechnology.com/sub-categories/blanket-for-offset-printing/ (last visited Apr. 7, 2016), which is incorporated herein by reference in its entirety. The face portion may comprise a relatively thin rubber material such as Nitrile butadiene rubber (NBR). As will be appreciated by one of skill in the art, NBR is a family of unsaturated copolymers of 2-propenenitrile and various butadiene monomers (1,2-butadiene and 1,3-butadiene). NBR is also known as Buna-N, Perbunan, acrylonitrile butadiene rubber, Nipol, Krynac and Europrene.

In another embodiment, the transfer blankets 6 may comprise a photopolymer material or a compound comprising at least in part a saturated chain of polymethylene. Suitable materials for the transfer blanket 6 are described in U.S. Patent Application Publication No. 2015/0217559 which is incorporated herein by reference in its entirety.

In operation, the transfer blanket 6 rotates in a first direction. The digital print units 4 transfer or spray a decorating material to an exterior surface portion of the transfer blanket 6 to form the decorations 7. In one embodiment, the transfer blanket 6 moves continuously at a predetermined rate. In another embodiment, transfer blanket 6 is indexed such that the transfer blanket 6 stops for a predetermined amount of time proximate to one or more of the digital print units 4. In this manner, the transfer blanket 6 may be substantially stationary as a digital print unit 4 forms a decoration 7 on the transfer blanket 6. Regardless, in another embodiment, movement of the transfer blanket 6 with respect to the digital print units 4 is at a rate selected by the control system 12. Accordingly, the control system 12 may control the rate and positions of decorations 7 formed by the digital print units 4 and movement of the transfer blanket 6 such that the decoration is subsequently transferred to a metallic container 22. In one embodiment, the control system 12 sends a signal to an actuator or drive unit of the blanket cylinder 18 to control the rate of movement of the blanket cylinder 18.

Optionally, the decorations 7 may be cured (or at least partially cured) by one or more curing units 16. In one embodiment, a curing unit 16 is associated with each digital print unit 4. In this manner, the decorating material jetted (or conveyed) by each of the digital print units 4 is at least partially cured or set before a subsequent digital print unit 4 conveys additional decorating material to the transfer blanket 6 to form a decoration 7. In another embodiment, only one curing unit 16D cures all of the decorating materials applied by the digital print units 4A, 4B, 4C, and 4D. In one embodiment, the curing units 16 generate a light of a wavelength selected to cure or set the decorating material conveyed by the digital print units 4. In one embodiment, the curing units 16 comprise a UV or UV LED cure lamp. In another embodiment, the curing units 16 generate thermal energy to cure the decorating material. In one embodiment, a curing unit 16 is adapted to cure a toner 52. In another embodiment, a curing unit 16 is adapted to cure an ink 43. Optionally, the curing unit 16 can cure both an ink 43 and a toner 52.

The feed unit 8 moves metallic containers 22 into a predetermined position with respect to the transfer blanket 6. An exterior surface portion 24 of the metallic containers 22 then rotates in contact with the exterior surface of the transfer blanket 6. In this manner, the decorating material, such as ink or toner, on the exterior surface of the transfer blanket forming the decoration 7 is transferred from the transfer blanket 6 to the metallic container.

In one embodiment, the feed unit 8 may rotate the metallic containers 22 such that the exterior surface 24 is in a predetermined alignment with respect to the decorator 2. More specifically, in one embodiment, the feed unit 8 can detect a registration mark on the metallic containers 22. The feed unit 8 can then rotate the metallic containers 22 such that the registration mark is in a predetermined alignment with respect to the transfer blanket 6. In this manner, the container exterior surface 24 will be in the predetermined alignment with the decorator 2. Optionally, a sensor detects the registration mark. In one embodiment, the registration mark is an indicia printed on the metallic container 22. In another embodiment, the registration mark is a protrusion, extension, or a depression formed on the metallic container. An example of a feed apparatus that may be used with decorators 2 of the present invention is described in U.S. Pat. No. 9,027,733 which is incorporated herein by reference in its entirety. In one embodiment, the control system 12 receives information on the registration mark. The control system 12 can then determine if the metallic container is in the predetermined alignment. If the metallic container is not in the predetermined alignment, the control system 12 can send a signal to the feed unit 8 to rotate the metallic container into the predetermined alignment.

In one embodiment of the present invention, the feed unit 8 operates at a different cycle rate (or speed) than the transfer blanket 6 rotates. More specifically, in a decorator 2A with multiple digital print units 4 and/or a segmented transfer blanket 6A (as illustrated in one embodiment of the present invention in FIG. 1), the rate at which metallic containers 22 are processed can be different than the print speed of the digital print units 4. In this manner, the decorator 2 can decorate metallic containers 22 with unique decorations 7 formed by digital printing technology, including an inkjet printer 41 or an electrophotographic system 40, at a faster rate than prior art inkjet container decorating systems or electrophotographic decorating systems.

In one embodiment, individual transfer blanket segments 6A are interconnected to the blanket wheel 18 such that the transfer blanket segments 6A can change velocity to match a rate of rotation of a metallic container 22 in the feed unit 8. Thus, the transfer blanket segments 6A may accelerate or decelerate to match a rate of rotation of a container exterior surface 24 for transfer of an image 7 to the container exterior surface portion 24. In one embodiment, the transfer blanket segments 6A are releasable interconnected to the blanket wheel 18. Optionally, the transfer blanket segments 6A separate from the blanket wheel 18 after transferring decorating material to a metallic container 22. In one embodiment, the digital print units 4 transfer decorating material to the transfer blanket segments 6A when the transfer blanket segments are separated from the blanket wheel 18. In another embodiment, there are more transfer blanket segments 6A than stations for the blankets on the blanket wheel 18. The transfer blanket segments 6A may follow two or more paths through the decorator 2 when separated from the blanket wheel 18. A first group of transfer blanket segments 6A may travel along a first path to receive decorating material from a first group of digital print units 4. A second group of transfer blanket segments 6A may follow a second path and receive decorating material from a second group of digital print units. In one embodiment, after receiving decorating material from a digital print unit, the transfer blanket segments 6A return to the blanket wheel 18. Optionally, in one embodiment, each transfer blanket segment 6A is interconnected to the blanket wheel 18 during transfer of decorating material to a metallic container 22. In this manner, after an image 7 is formed on the transfer blanket segment 6A, the transfer blanket segment 6A may accelerate, or decelerate, to match the velocity of the exterior surface portion 24 of the metallic container 22.

In another embodiment of the present invention, each individual blanket segment 6A is arranged on a mandrel interconnected to the blanket wheel 18. Each mandrel may rotate independently around a mandrel axis that is substantially parallel to an axis of the blanket wheel 18. In this manner, each individual blanket segment 6A may rotate on an associated mandrel at a first rate when the digital print units 4 form the decoration 7 on the transfer blanket segment 6A. Further, each individual blanket segment 6A may rotate on its associated mandrel at a second rate during transfer of the decoration 7 to a metallic container 22 positioned by the feed unit 8. The second rate of rotation of the individual blanket segment 6 may be selected to match a rate of rotation of the metallic container 22.

In another embodiment, the individual transfer blanket segments 6A are separated by a distance 15 that may be varied. Accordingly, two adjacent transfer blanket segments 6A may be separated by a distance 15A proximate to one or more of the digital print units 4. The adjacent transfer blanket segments 6A may be separated by a second distance 15B proximate to the feed unit 8. In one embodiment, the first distance 15A is less than the second distance 15B. Optionally, the first distance 15A may be less than about 1 inch such that the transfer blanket segments 6A pass by the digital print units 4 substantially continuously. In this manner, the transfer blanket segments 6A have a first linear speed proximate to the digital print units 4 and a second linear speed proximate to the feed unit 8. In one embodiment, the first linear speed is slower than the second linear speed. Accordingly, the transfer blanket segments 6A may move relatively slowly proximate to the digital print units 4. Continuing this example, the transfer blanket segments 6A move faster proximate to the feed unit 8 and the metallic containers 22. Thus, the transfer blanket segments 6A may accelerate to match a radial speed of the exterior surface portion 24 of the metallic container 22 at the feed unit 8.

In one embodiment, the transfer blanket segments 6A are interconnected to the blanket wheel 18 such that the transfer blanket segments 6A may move independent of the constant rotation of the blanket wheel 18. In another embodiment, the transfer blanket segments are interconnected to the blanket wheel 18 by one or more of pivot joints, rollers, cams, and springs. In this manner, a transfer blanket segment 6A may dwell at a first position and accelerate at another position. By dwelling and predetermined positions, the transfer blanket segment 6A may remain for a longer period of time proximate to one or more elements of the decorator, such as one or more of a digital print unit 4, a curing unit 16, the feed unit 8 during image transfer to a metallic container 22, and at the cleaning system 14.

Figure 1A:
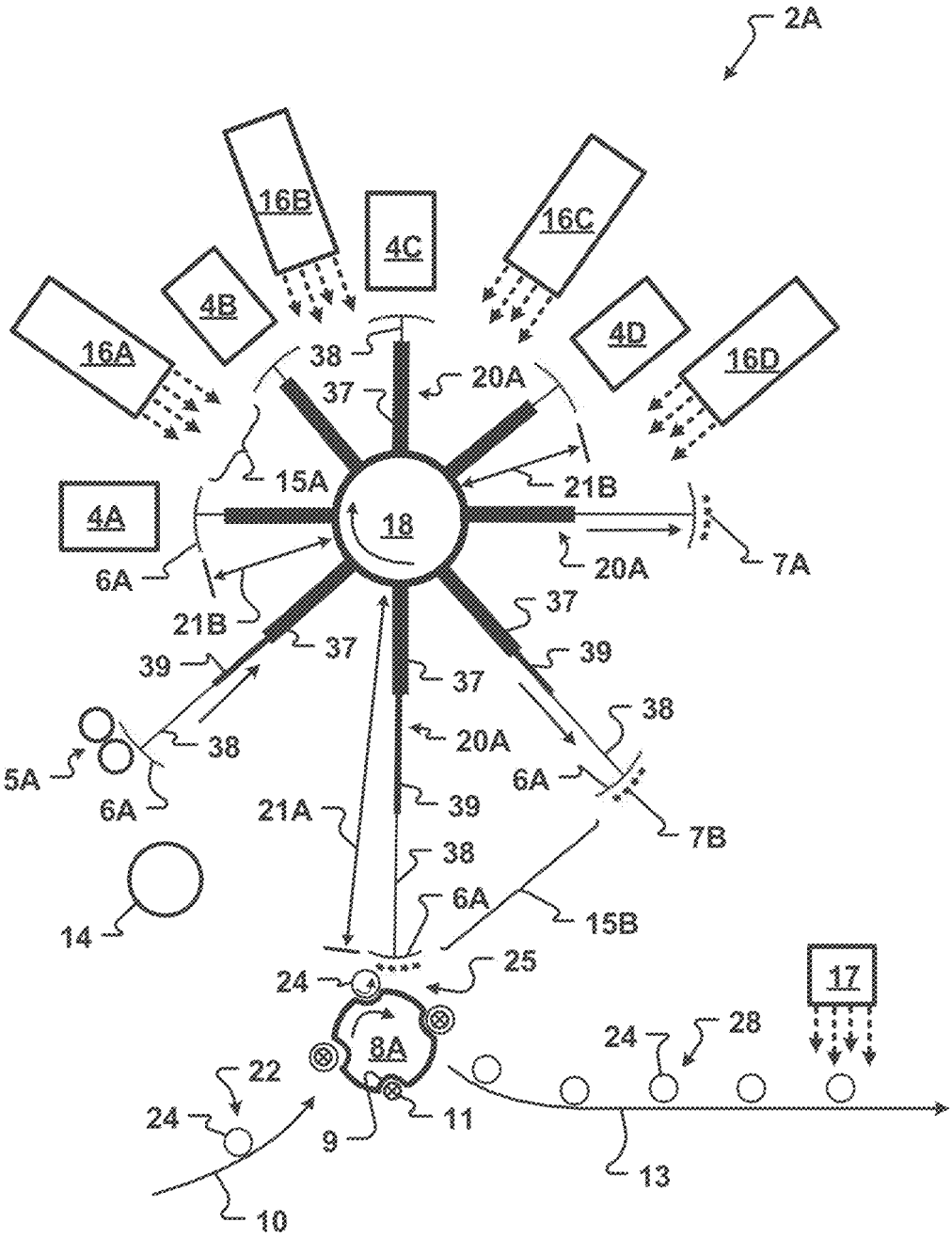
FIG. 1A is a schematic flow diagram of a decorator including blanket supports with variable lengths such that the relative velocity of a transfer blanket segment can be altered as the blanket support rotates.

Referring now to FIG. 1A, in one embodiment of the present invention, the transfer blanket segments 6A are interconnected to the blanket wheel 18 by blanket supports 20A. Each blanket segment 6A is connected to an end of a blanket support 20A extending from the blanket wheel. The blanket supports 20A position the blanket segments 6A a predetermined distance 21 from the blanket wheel 18. Optionally, the blanket supports 20A project radially from the blanket wheel 18. In one embodiment, the blanket supports 20A are oriented approximately perpendicular to an axis around which the blanket wheel 18 rotates.

The blanket supports 20A can alter positions of their associated blanket segments 6A with respect to the blanket wheel 18. In one embodiment, the blanket supports 20A are operable to alter the distance 21 between the blanket wheel 18 and the blanket segments 6A. Accordingly, the blanket supports 20A can increase and decrease the distance 21 between the blanket wheel and the blanket segments as the blanket wheel 18 rotates. In this way, each blanket segment 6A can have an elliptical path (or orbit) around the blanket wheel 18. Moreover, the relative velocity of the blanket segments 6A may change with respect to the digital print units 4 and the image transfer position 25. Further, the transfer blankets 6A may have a first spacing 15A at a first position of the decorator 2A and a second spacing 15B at a second position of the decorator 2A. Optionally, proximate to the digital print units 4, the first spacing 15A is less than the second spacing 15B proximate to the image transfer position 25.

In one embodiment, the blanket segments 6A are a first distance 21A from the blanket wheel 18 proximate to the image transfer position 25. The blanket segments 6A are a second distance 21B from the blanket wheel 18 proximate to the digital print units 4. In one embodiment, the first distance 21A is greater than the second distance 21B. Accordingly, in one embodiment, the transfer blankets 6A move faster relative to metallic containers 22 being decorated at the image transfer position 25 and slower relative to the digital print units 4 during transfer of decorating material to the transfer blankets 6A.

The blanket supports 20A can alter the distance 21 between the blanket wheel 18 and the blanket segments 6A in a variety of ways. In one embodiment, the blanket supports 20A can at least partially retract into the blanket wheel 18. For example, in one embodiment the blanket wheel 18 includes a recess or bore (not illustrated for clarity) associated with each blanket support 20A. A portion of the blanket supports 20A can selectively retract into, or extend out of, an associated bore of the blanket wheel 18. In this manner, the distance 21 between a blanket segment 6A and the blanket wheel 18 can be adjusted as the blanket wheel rotates.

The blanket segments 6A can have a curved or arcuate shape. Optionally, in one embodiment, a blanket support 20A is configured to adjust the shape of a blanket segment 6A as the blanket segment 6A rotates around the blanket wheel 18. For example, when the blanket support 20A extends the blanket segment 6A distally from the blanket wheel 18, such as proximate to the image transfer position 25, the blanket support can alter the shape of the blanket segment 6A to be more planar. Additionally, or alternatively, when the blanket support moves the blanket segment 6A closer to the blanket wheel, the blanket support can adjust the shape of the blanket segment to be more arcuately shaped and less planar.

Additionally, or alternatively, in one embodiment, the blanket supports 20A can have an adjustable length. For example, the blanket supports 20A may include at least two sections 37-39. The sections may be telescoping such that the length of each blanket support 20A may be adjusted. In one embodiment, the at least two section comprise a first section 37 and a second section 38. The second section 38 may fit at least partially within the first section 37. Optionally, the blanket supports 20A may include a third section 39. The second section 38 may fit at least partially in the third section 39 and the third section 39 can extend from, or retract into, the first section 37.

Figure 1B:
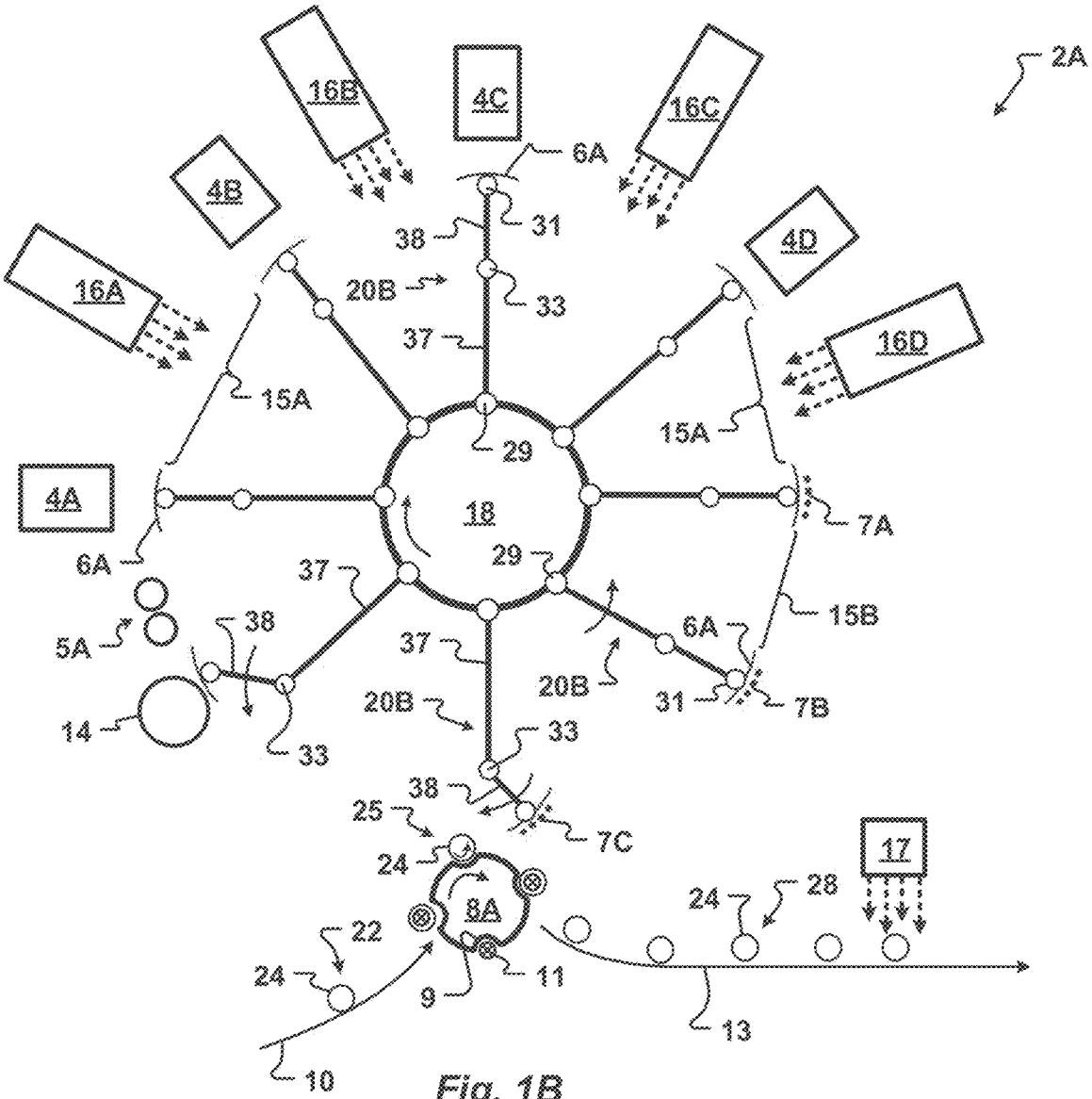
FIG. 1B is a schematic flow diagram of a decorator in which transfer blanket segments are interconnected to a blanket support that can pivot with respect to a blanket wheel.

Referring now to FIG. 1B, in another embodiment of the present invention, blanket supports 20B interconnected to the blanket wheel 18 may pivot with respect to the blanket wheel. In this manner, the blanket support 20B may move a transfer blanket 6A at different velocities with respect to a digital print unit 4 compared to a metallic container 22 to be decorated at the image transfer position 25. In one embodiment, the blanket support 20B pivots or moves a transfer blanket segment 6A relative to a digital print unit 4 at a first velocity. The blanket support 20B may move the transfer blanket segment 6A relative to a metallic container 22 at the image transfer position 25 at a second velocity. In one embodiment, the first velocity is less than the second velocity. In this manner, the blanket support 20B moves the transfer blanket segment 6A slower relative to the digital print units 4 and faster relative to a metallic container 22 during decoration transfer at the transfer position 25.

In one embodiment, the blanket supports 20B may be pivotally interconnected to the blanket wheel 18 by a pivot joint 29. In this manner, the blanket supports 20B can pivot at a variety of angles with respect to the blanket wheel. For example, blanket support 20B with image 7B has pivoted around a pivot joint 29 such that image 7B is proximate to a blanket support with image 7A. In this way, the blanket segment with image 7B is separated from the blanket segment with image 7A by a distance 15B. The distance 15B between the blanket segments is less than a distance 15A when the blanket supports 20B project substantially radially (or are not pivoted) with respect to the blanket wheel, such as proximate to the digital print units 4. Optionally, the blanket supports 20B can rotate by between approximately −45° to approximately +45° with respect to a radius of the blanket cylinder.

In one embodiment, the blanket segments 6A are connected to an outer portion of the blanket support 20B by a second pivot joint 31. Accordingly, an exterior surface of the blanket segments 6A can be pivoted to a predetermined orientation as the blanket wheel 18 rotates. In one embodiment, a blanket segment 6A is configured to rotate around the second pivot joint 31 with respect to a blanket support 20B such that the exterior surface of the blanket segment is in a predetermined orientation with respect to one or more of a cleaning system 14, a digital print unit 4, a curing unit 16, a feed unit 8, a cleaning system 14, and a temperature control device 5.

In one embodiment, the blanket supports 20B include two or more sections 37, 38 that are pivotally connected. More specifically, a blanket support 20B may include a first section 37 interconnected to the blanket wheel 18. A second section 38 of the blanket support 20B is interconnected to a transfer blanket 6A. Optionally, the first and second sections 37, 38 of the blanket support 20B are pivotally interconnected. For example, a first section 37 can be connected to a second section 38 by a third pivot joint 33. Optionally, the blanket supports 20B are operable to alter the distance separating the transfer blankets 6A from the blanket cylinder 18 in a manner similar to, or the same as, the blanket supports 20A described in conjunction with FIG. 1A.

Referring again to FIG. 1, in one embodiment of the present invention, the feed unit 8A has a shape that is generally cylindrical. Optionally, the feed unit 8A may include a plurality of stations 9 to receive and support metallic containers 22 in a predetermined position with respect to a transfer blanket 6. In one embodiment, the feed unit 8 is operable to rotate a metallic container 22 such that the exterior surface 24 moves at a rate substantially equal to a rate of rotation of the transfer blanket 6. In this manner, dynamic effect to the transfer blanket 6 is minimized.

In one embodiment, the feed unit 8A includes mandrels 11 to support and/or rotate the metallic containers 22. Optionally, the mandrels 11 may be associated with the stations 9. In one embodiment, each mandrel 11 may rotate around an axis substantially parallel to an axis of rotation of the feed unit 8A. In one embodiment, a mandrel 11 with a metallic container 22 thereon may rotate such that a predetermined exterior surface portion of the metallic container 22 contacts the transfer blanket 6A. Optionally, a servo drive unit or other mechanical or electrical means is operable to rotate the mandrels 11. In one embodiment, a servo drive is associated with each of the mandrels. In another embodiment, the servo drive is controlled by a signal from the control system 12. In another embodiment, a torque motor is associated with the mandrels 11.

Alternatively, the rotation of the mandrels 11 may be in response to a mechanical force. In one embodiment, the rotation of the mandrels of the feed unit 8A is controlled by a belt or chain interconnected to the blanket wheel 18. In this manner, the rotation of the mandrels 11, and metallic containers 22 thereon, may be synchronized with the rotation of the transfer blankets 6A.

Optionally, the mandrels 11 move the metallic containers 22 into contact with a transfer blanket segment 6A at an image transfer location 25. In one embodiment, a mandrel 11 of the feed unit 8A is positioned at least partially within an interior of a metallic container 22 supported by the feed unit 8A. In this manner, the mandrel may support a sidewall portion of the metallic container 22 during contact of the metallic container with a transfer blanket segment 6A. The mandrel 11 may be configured to force the exterior surface 24 of the metallic container 22 against a transfer blanket such that decorating material is transferred to the metallic container. In another embodiment, the mandrel 11 contacts an exterior surface portion of the metallic container 22. Optionally, the mandrel may support metallic container 22 by contact with a closed end-wall portion of the metallic container 22.

After a decoration 7 is transferred to a metallic container 22, the transfer blanket segment 6 may optionally be cleaned by a cleaning system 14. For example, in one embodiment of the present invention, the cleaning system 14 removes any residual ink or toner from the exterior surface of the transfer blanket segment 6 before new decorating material is applied by a digital print unit 4 to form a new decoration 7 on the transfer blanket segment 6. In one embodiment, the cleaning system 14 contacts the exterior surface of the transfer blanket segment 6 during the cleaning. In another embodiment, the cleaning system 14 cleans the transfer blanket segment 6 without contact.

The decorator 2 can optionally include a temperature control device 5A. The temperature control device 5A is operable to adjust the temperature of the transfer blanket segments 6A. Specifically, the temperature control device 5A can heat or cool the blanket segments 6A to a predetermined temperature. In this manner, the temperature control device 5A can alter characteristics of decorating materials, such as ink, applied to the blanket segments 6A. More specifically, viscosity of the ink can be adjusted by altering the temperature of the blanket segments 6A. The temperature of the blanket segments 6A can also alter other characteristics of ink applied by the digital print units 4. For example, altering the temperature of blanket segments can: affect the flow of the ink on the blanket segments, change the thickness of ink on the blanket segments, and change the appearance of the ink. In one embodiment, the temperature of the blanket segments can be adjusted to change the size of ink droplets used to form a decoration 7. The temperature of the blanket segments 6A can also be adjusted by the temperature control device 5A to thermally pre-pin, or at least partially set or cure, decorating materials including ink applied to the blanket segments. For example, heating the blanket segments to a predetermined temperature can thermally cure, or "pre-pin" the ink. In one embodiment, ink 43 transferred to a blanket segment from a digital print unit 4 (such as an inkjet print head 41) is at least partially thermally cured upon contact with a blanket segment heated to a predetermined temperature. More specifically, the temperature control device 5A can adjust the temperature of a transfer blanket segment 6A such that a first ink 43 conveyed to the transfer blanket segment by a first digital print unit 4A is at least partially cured or set before a second digital print unit 4B conveys a second ink 43 to the transfer blanket segment.

In one embodiment, the temperature control device 5A comprises at least one roller. The roller is aligned with respect to the blanket wheel 18 such that each transfer blanket segment 6A is contacted by the roller. The temperature control device 5A can heat or cool the blanket segments. In one embodiment, the temperature control device 5A is interconnected to a source of a fluid. The fluid source can include a heating element and a cooling element. Optionally, the fluid may be water. In another embodiment, the fluid is an oil or a gas. Additionally, or alternatively, the temperature control device 5A can include an electrical heating element.

In one embodiment, the control system 12 is in communication with the temperature control device 5A. The control system can send a signal to the temperature control device 5A to adjust the temperature of the blanket segments 6A.

In one embodiment, the temperature control device 5A is positioned to contact an exterior surface of the transfer blanket segments 6A as generally illustrated in FIG. 1. The temperature control device 5A can be located at any position around the circumference of the blanket wheel 18. In one embodiment, the temperature control device 5A is positioned between an image transfer position 25 and the first digital print unit 4A. Other locations for the temperature control devices 5 are contemplated. In one embodiment, the temperature control device 5 is associated with the blanket wheel 18. More specifically, the blanket wheel 18 may have a temperature control device 5 associated with each transfer blanket segment 6A. For example, a temperature control device can be included in the blanket wheel 18 at each position at which a transfer blanket segment will be interconnected.

Metallic containers 22 are transported to the feed unit 8 by a conveyor 10. In one embodiment of the present invention, the feed unit 8 receives the metallic containers 22 from upstream equipment 26. The metallic container 22 may be a beverage container, such as a beverage can or a beverage bottle, an aerosol container, a can for a food product, or a container for any other type of product. The upstream equipment 26 may comprise a draw and iron production line or an impact extrusion production line. An example of a known draw and iron metallic container production line is generally illustrated and described in "Inside a Ball Beverage Can Plant," available at http://www.ball.com/Ball/media/Ball/Global/Downloads/How_a_Ball_Metal_Beverage_Can_Is_Made.pdf?ext=.pdf (last visited Apr. 30, 2016) which is incorporated herein by reference in its entirety. Methods and apparatus of forming metallic containers in an impact extrusion production line are described in U.S. Patent Application Publication No. 2013/0068352 and U.S. Patent Application Publication No. 2014/0298641 which are each incorporated herein by reference in their entirety.

Optionally, in another embodiment, the feed unit 8 receives end closures 34 from an end closure orientation system. Embodiments of end closure orientation and decorating systems are described in U.S. Pat. Nos. 9,259,913 and 9,340,368 which are each incorporated herein by reference in their entirety. The feed unit 8 then moves the end closures 34 into contact with the transfer blankets 6 of the decorator 2.

In one embodiment of the present invention, the upstream equipment 26 comprises a first printer or decorator. The first decorator may form a first decoration 23 on the exterior surface portion 24 of the metallic containers 22. In one embodiment, the first decoration 23 comprises a base coat. In another embodiment, the first decoration 23 may comprise one or more of text, numerals, and images.

In one embodiment, the first decoration 23 includes a window or a void portion formed on a metallic container 22. The decorators 2 of the present invention are operable to form a decoration 7 that is subsequently transferred to the metallic container such that the decoration 7 aligns with the first decoration 23 and the window. For example, the first decoration 23B may comprise an image, such as a jersey, an example of which is shown on container 28B. The decorator 2 may form a decoration 7 on the transfer blanket 6 which is subsequently transferred to the metallic container 28B. The decoration may include (but is not limited to) decoration 30C comprising the number "92," that is in a predetermined alignment with respect to the first decoration 23B. One skilled in the art will appreciate that the first decoration 23 and the decoration 30 formed by the decorator 2 may have any relative size and arrangement with respect to one another.

Optionally, the upstream equipment 26 may comprise a surface treatment unit 27. The surface treatment unit 27 can prepare the exterior surface portion 24 of a metallic container 22 to receive a decoration 7 from the transfer blanket 6. In one embodiment, the surface treatment unit 27 treats the exterior surface portion 24 by one or more of a plasma treatment, an anodizing treatment, applying a base coat material, and applying a pre-coating. In one embodiment, the plasma treatment comprises a corona surface treatment, or an air plasma treatment, that uses a low temperature corona discharge plasma to change the surface properties of the metallic container 22. In another embodiment, one or more of a corona surface treatment, flame plasma treatment, chemical plasma treatment, electroplating, electrostatic plating, chemical coating, anodic oxidation, hot dipping, and thermal spraying may be performed to pre-treat the exterior surface 24 of the metallic container 22. The pretreatment generally improves adhesion and bonding between a decoration 7 applied by the decorator 2 and the exterior surface 24 of the metallic container 22.

The decorated metallic containers 28 are transported from the feed unit 8, for example, by a conveyor 13 to downstream equipment 32. Any suitable conveyor 13 may be used with the decorator 2 of the present invention. Conveyor 13 may be the same as, or similar to, conveyor 10. In one embodiment, one or more of conveyors 10, 13 comprise a belt or a chain. In one embodiment, conveyor 13 is a pin chain. Suitable pin chains are known to those of skill in the art and include those described in U.S. Pat. App. Pub. 2017/0334659 which is incorporated herein in its entirety by reference.

Optionally, in one embodiment of the present invention, the conveyor 13 transports the decorated metallic containers 28 to a curing unit 17. The curing unit 17 may be the same as, or similar to curing unit 16. Accordingly, the curing unit 17 is operable to at least partially cure the decorating material forming the decorations 30 on the container exterior surface 24. The curing unit 17 may use at least one of thermal energy and light of a predetermined wavelength to cure or set the decorating material. In one embodiment, the curing unit 17 comprises a UV or UV LED cure lamp. In another embodiment, the curing unit 17 is operable to cure or set the decorating material using thermal energy. The curing unit 17 may be used with, or instead of, curing unit 16. More specifically, in one embodiment, the decorator includes only one of curing unit 16 and curing unit 17. The curing unit 17 is operable to cure one or more of ink and toner on the metallic containers 28.

In one embodiment, the downstream equipment 32 includes one or more of a coater, an oven, a waxer, a die necker, a tester, an inspection station, and a palletizer. The coater applies a lacquer (or other material, such as a varnish) to the interior of the metallic container 28. The oven cures the lacquer. A thin layer of a lubricant may be applied by a waxer to a portion of the container body proximate to an open end of the metallic container 28. The die necker reduces the diameter of a portion of the metallic container body and applies a curl to aerosol containers. The tester checks the container for unintended apertures or leaks. The inspection station may check the shape or other features of the metallic container 28. The palletizer can bundle the finished metallic containers 28 for shipment or storage.

Examples of decorated metallic containers 28A, 28B are also illustrated in FIG. 1. The metallic containers 28A, 28B each include unique decorations 30A, 30B, 30C on the exterior surface portion 24. Additionally, the decorations 30 may be in a predetermined alignment with respect to a first decoration 23 applied by the upstream equipment 26. It will be appreciated that a decoration 30 may be formed at any location on an exterior surface portion 24 of a metallic container 28. Further, the decorations 30 may include text, customer identification information, branding information, directions of use, or any other desired decoration or indicia.

Additionally, as described above, the decorator 2 may be used to decorate end closures 34, ROPP closures, and crown caps 36. Examples of an end closure 34 and a crown cap 36 with decorations 30 formed by a decorator 2 of the present invention are also illustrated in FIG. 1.

Figure 1C:
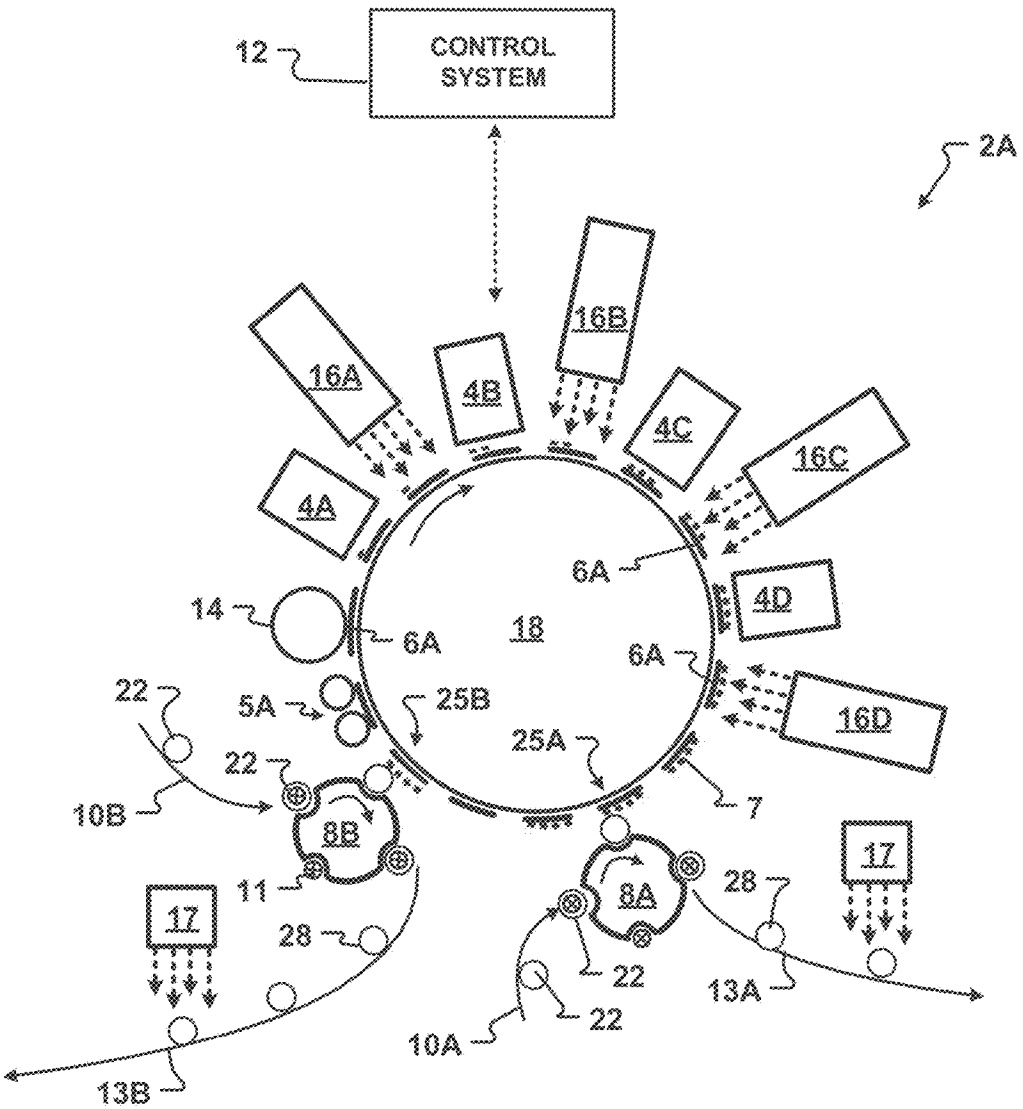
FIG. 1C is a schematic flow diagram of a decorator including two feed units aligned with a blanket cylinder having transfer blanket segments thereon.

Optionally, two or more feed units 8 may be associated with decorator 2A. More specifically, and referring now to FIG. 1C, in one embodiment of the present invention, decorator 2A includes at least two feed units 8A, 8B. The decorator 2A includes a plurality of transfer blanket segments 6A. The blanket segments 6A are sequentially arranged on a blanket wheel 18. The feed units 8A, 8B are aligned with respect to the blanket wheel 18 such that feed unit 8A picks up every other decoration 7 formed on a transfer blanket segment 6A. More specifically, feed unit 8A moves metallic containers 22 into contact with every other transfer blanket segment 6A at a first image transfer position 25A. The second feed unit 8B moves metallic containers 22 into contact with alternating transfer blanket segments 6A at a second image transfer position 25B. In this manner, the decorator 2A may operate at a different rate compared to a container production run. Additionally, or alternatively, the blanket wheel 18 can rotate at a faster rate compared to a decorator 2 with only one feed unit. Because the decorator 2A includes two feed units 8A, 8B, although the blanket wheel 18 rotates faster, the cycle rate of the feed units 8A, 8B can be the same as, or similar to, the cycle rate of feed unit 8 of the decorator illustrated in FIG. 1. In this manner, decorator 2A illustrated in FIG. 1C can decorate more containers per hour than the decorator of FIG. 1.

Figure 3:
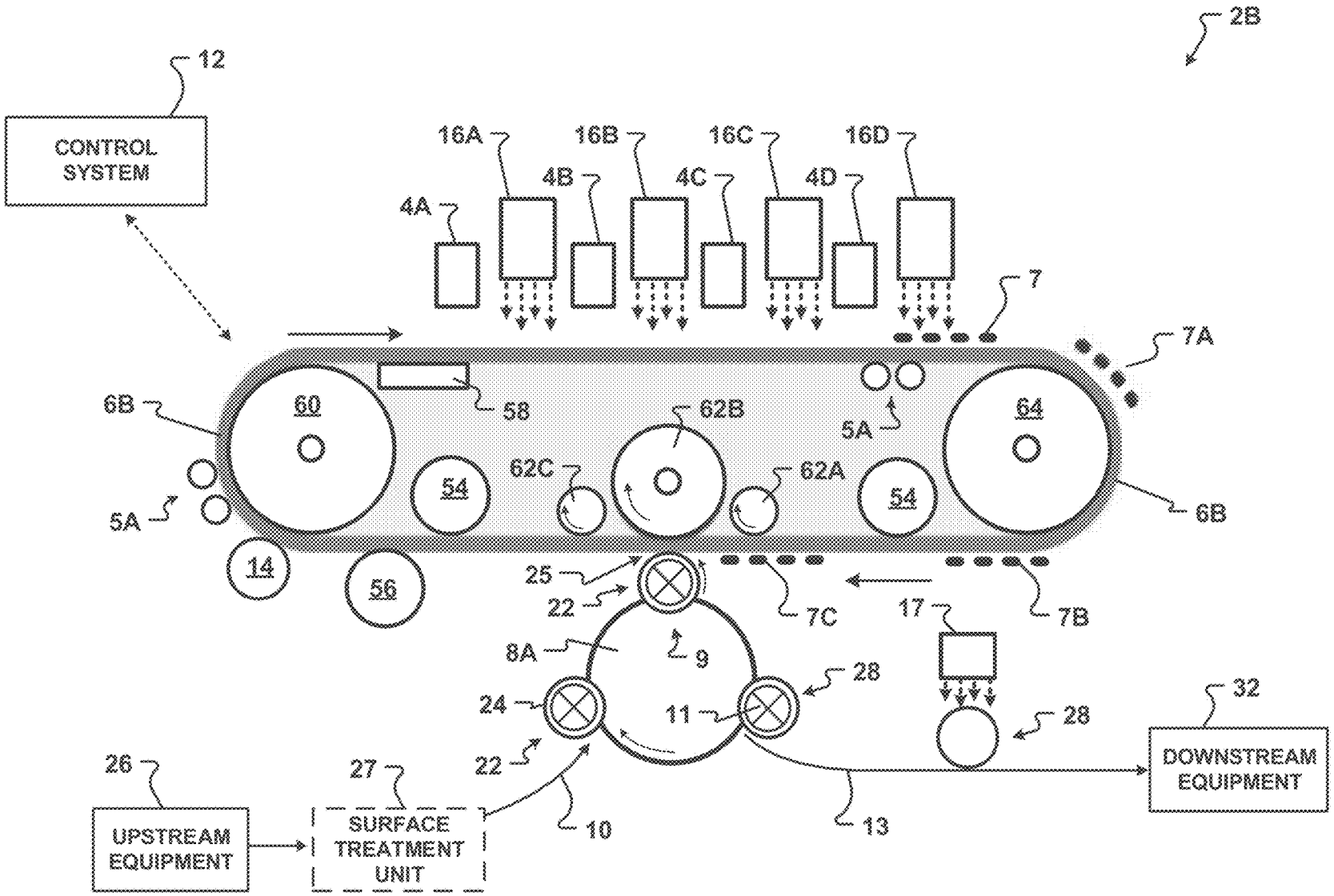
FIG. 3 is another schematic flow diagram of another embodiment of a decorator of the present invention including a continuous transfer blanket.

Referring now to FIG. 3, a decorator 2B of another embodiment of the present invention is generally illustrated. The decorator 2B includes digital print units 4, one or more curing units 16, and a feed unit 8A, and, optionally a curing unit 17, that are the same as, or similar to decorator 2A. Decorator 2B also includes a continuous transfer blanket 6B. Specifically, the transfer blanket 6B is at least one endless loop of blanket material. The digital print units 4 may include an inkjet print head 41 operable to transfer an ink 43 to the transfer blanket 6B such as illustrated in FIG. 2A. Optionally, at least one of the digital print units 4 may be an electrophotographic system 40 as generally illustrated and described in conjunction with FIG. 2B. The relative positions and order of the digital print units 4 may be altered.

The decorator 2B can include at least one temperature control device 5A configured to heat or cool the transfer blanket 6B. The temperature control device 5A can be positioned to contact an exterior surface of the transfer blanket 6B. Additionally, or alternatively, the decorator 2B can include a temperature control device 5A positioned to contact an interior surface of the transfer blanket 6B.

In one embodiment, the transfer blanket 6B has a width 65 (illustrated in FIG. 5) which is not less than a height of a metallic container 22 to be decorated. Optionally, the blanket width 65 may be greater than the container height. In one embodiment, the transfer blanket 6B is formed of the same or similar materials as the transfer blanket segments 6A. The transfer blanket 6B may have any desired length. In one embodiment, the transfer blanket 6B has a length of between approximately 5 m and approximately 20 m. In another embodiment, the length of the transfer blanket 6B is up to approximately 50 m.

The transfer blanket 6B is tensioned to prevent inadvertent or unintended movement. More specifically, in one embodiment, the decorator 2B is operable to maintain the transfer blanket 6B at a tension sufficient to counteract forces received from metallic containers 22 that contact the transfer blanket 6B to receive a decoration 7.

In one embodiment, the decorator 2B includes one or more tensioning devices 54-62. The tensioning devices may selectively contact the transfer blanket 6B. In this manner, in one embodiment, the tensioning devices 54-62 may alter the tension of the transfer blanket 6B. In one embodiment, the tensioning devices of decorator 2B include at least one of an inside idler 54, a backside idler 56, a shoe tensioner 58, a rotary tensioner 60, and an impression roller 62. In one embodiment, a surface of the shoe tensioner 58 configured to contact the transfer blanket 6B has a shape that is generally arcuate. The shoe tensioner 58 may be of any size. Other arrangements and positions of the tensioning devices 54-62 are contemplated.

In one embodiment of the present invention, decorator 2B includes one impression roller 62 proximate to image transfer position 25. Optionally, a backside idler 56 is positioned after one or more of the servo drive 64 and the image transfer position 25. An inside idler 54 may be positioned just before the servo drive 64. A second inside idler 54 may be positioned following the image transfer position 25. Optionally, a dual-roller tensioner 60A may be positioned after the image transfer position 25. The shoe tensioner 58 may also be positioned after the image transfer position 25 and before the first digital print unit 4.

Figure 3A:
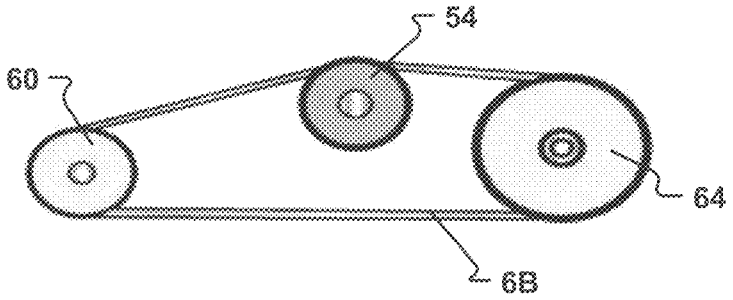
FIG. 3A is a partial view of the decorator of FIG. 3 illustrating an inside idler in one position of use engaged with the continuous transfer blanket.
Figure 3B:
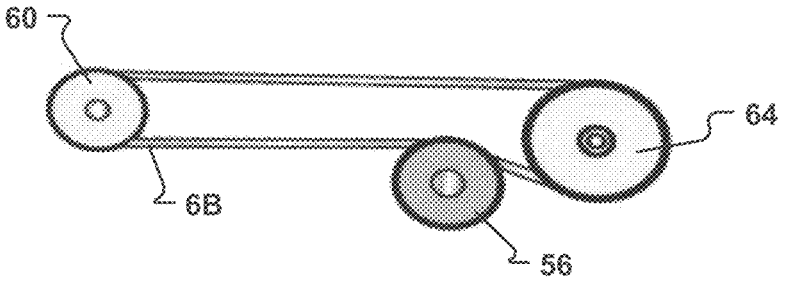
FIG. 3B is another partial view of the decorator of FIG. 3 showing a backside idler engaged with the continuous transfer blanket.

Optionally, one or more of the tensioning devices (such as the inside idler 54, the backside idler 56, the shoe tensioner 58, the rotary tensioner 60, and the impression roller 62) may be interconnected to actuators. More specifically, the tensioning devices 54-62 may be adjustably positioned with respect to the transfer blanket 6B. In this manner, one or more of the tensioning devices 54-62 may move with respect to the transfer blanket 6B. In another embodiment, the control system 12 may send signals to one or more actuators associated with the tensioning devices 54-62. The signals may cause the actuators to move an associated tensioning device 54-62 in a specific direction. For example, and referring to FIG. 3A, a signal from the control system 12 may cause an actuator associated with an inside idler 54 to press against an interior surface of the transfer blanket 6B. In this manner, the insider idler 54 may alter tension of the transfer blanket 6B. Similarly, and referring now to FIG. 3B, the control system 12 may send a signal to an actuator of a backside idler 56 to move inwardly with respect to the transfer blanket 6B to alter the tension of the transfer blanket.

Figure 3C:
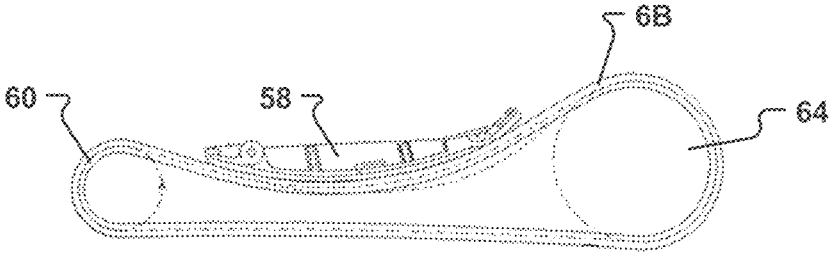
FIG. 3C is yet another partial view of the decorator of FIG. 3 in which a shoe tensioner 58 is illustrated after moving relative to the continuous transfer blanket.

Referring now to FIG. 3C, the shoe tensioner 58 is illustrated in an engaged position in contact with an exterior surface of the transfer blanket 6B. More specifically, the shoe tensioner 58 is generally illustrated in a position adjusted by an actuator. In this manner, the shoe tensioner 58 may move relative to the transfer blanket 6B in response to a signal received from the control system 12. FIG. 3C also illustrates a shoe tensioner 58 with a surface having a shape that is generally arcuate in contact with the transfer blanket. The shoe tensioner may have any predetermine size. Further, a radius of curvature of the arcuate shaped surface may be of any predetermined dimension.

By selectively arranging tensioning devices 54-62 around interior and exterior surfaces of the transfer blanket 6B, the tension of the transfer blanket 6B may be adjusted to be substantially constant. Further, the arrangement of tensioning devices 54-62 may be selected to prevent or reduce vibration of the transfer blanket 6B. Additionally, the combination of tensioning devices 54-62 may eliminate or decrease warping or other unintended movement of the transfer blanket.

In one embodiment, one or more of the tensioning devices 54, 56, 60, 62 may be driven to provide rotation to the transfer blanket 6B. In another embodiment, the tensioning devices 54, 56, 60, 62 may be freewheeling.

Figure 3D:
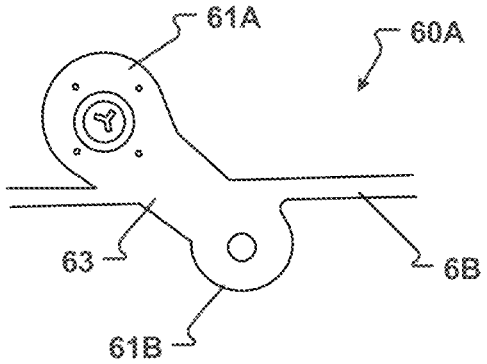
FIG. 3D is a partial view of a tensioner with two-rollers associated with a continuous transfer blanket.

In one embodiment, the rotary tensioner 60 includes two or more rollers 61 as a dual roller rotary tensioner 60A, illustrated in FIG. 3D. More specifically, a rotary tensioner 60A of one embodiment of the present invention may include a first roller 61A configured to contact a first side of the transfer blanket 6B. A second roller 61B may be configured to contact a second side of the transfer blanket 6B. The rollers 61A, 61B are interconnected by a linkage 63. Optionally, the rollers 61A, 61B may have the same or different diameters. In one embodiment, the rotary tensioner 60A may be used with the decorator 2B in addition to, or in place of, the rotary tensioner 60.

Optionally, the decorator 2B includes an impression roller 62. In one embodiment, the impression roller 62 applies a force to the transfer blanket 6B during transfer of a decoration 7 to a metallic container 22. In another embodiment, the impression roller 62 applies the force to a surface of the transfer blanket 6B that is substantially opposite to an exterior surface of the transfer blanket which contacts a metallic container 22 during transfer of a decoration to the metallic container.

In one embodiment, the impression roller 62 applies a force to the transfer blanket 6B that is substantially equal to a force applied to the transfer blanket by a metallic container 22 during transfer of a decoration 7 to the metallic container. In this manner, the impression roller 62 eliminates, or minimizes, dynamic effect on the transfer blanket 6B. Balancing forces applied to the transfer blanket by the impression roller 62 and the metallic container 22 may also minimize wear of the transfer blanket. Accordingly, the decorator 2 may operate for a longer period of time without service compared to a similar decorator that does not balance the force received from a metallic container.

In one embodiment, a decorator 2 may include a plurality of impression rollers 62A, 62B, 62C. The impression rollers 62 may be oriented to alter the tension of the transfer blanket 6B proximate to a feed unit 8. For example, decorator 2B may include two or more impression rollers 62 such that the tension of the transfer blanket 6B at a transfer position 25 proximate to the feed unit 8A is different than the tension of other portions of the transfer blanket 6B. Isolating the tension of the transfer blanket proximate to contact between the transfer blanket and a metallic container may minimize or eliminate unintended and inadvertent movement of the transfer blanket 6B during contact of the transfer blanket 6B with the metallic container 22 during decoration pickup. Accordingly, the force received from the metallic container 22 does not result in unintended movement of the transfer blanket 6B when the digital print units 4 convey decorating material to the transfer blanket 6B. In this manner, decoration quality is improved.

In one embodiment, the decorator 2B includes a first impression roller 62A upstream of a position 25 at which the decorating material 7 is transferred from the transfer blanket 6B to a metallic container 22. Optionally, a second impression roller 62B may be positioned substantially at the transfer position 25. In one embodiment, a third impression roller 62C may be positioned downstream from the transfer position 25.

In one embodiment, the decorator 2B includes at least one servo drive 64 operable to rotate the transfer blanket 6B at a predetermined rate. The servo drive 64 is configured to apply a force to the transfer blanket 6B such that the transfer blanket 6B rotates at the predetermined rate. In one embodiment of the present invention the servo drive 64 is configured to pull the transfer blanket 6B. Additionally, or alternatively, the servo drive 64 may be configured to push the transfer blanket 6B. Optionally, a first servo drive 64 may be configured to push the transfer blanket 6B and a second servo drive 64 may be configured to pull the transfer blanket 6B.

The servo drive 64 may rotate the transfer blanket 6B substantially continuously. Optionally, the servo drive 64 may alter the rate of rotation of the transfer blanket 6B. For example, in one embodiment of the present invention, the servo drive 64 decreases the rotation rate. The decreased rotation rate may be associated with one or more operations of the decorator 2B. More specifically, in one embodiment, the servo drive 64 decreases the rotation rate during curing of decorations 7 by one or more curing units 16. In another embodiment, the rotation rate of the transfer blanket 6B is increased by the servo drive 64 during other operations of the decorator 2B. Accordingly, in another embodiment, the servo drive 64 increases the rotation rate during one or more of transfer of decorating material to the transfer blanket 6B by a digital print unit 4 and transfer of a decoration 7 to a metallic container 22.

In another embodiment, the servo drive 64 rotates the transfer blanket 6B intermittently. More specifically, the servo drive 64 may periodically start and stop rotation of the transfer blanket 6B. In this manner, the transfer blanket 6B may stop periodically during formation of decorations 7 by the digital print units 4, during curing of decorating material by the curing units 16, and/or during transfer of decorations 7 to a metallic container 22. In this manner, the transfer blanket 6B may be in a fixed orientation with respect to a metallic container 22 during transfer of a decoration 7 to the metallic container 22.

In one embodiment, the servo drive 64 is a load-balancing servo drive. The load-balancing servo drive 64 may adjust a force applied to the transfer blanket 6B to maintain a substantially constant rate of rotation of the transfer blanket 6B. More specifically, the load-balancing servo drive 64 can apply more, or less, force to maintain the blanket rate of rotation substantially constant. In one embodiment, the load-balancing servo drive 64 is configured adjust the force applied to the transfer blanket 6B such that tension in the blanket 6B is substantially constant. In this manner, the load-balancing servo drive 64 can maintain constant tension in the transfer blanket 6B at one or more positions. In one embodiment, the load-balancing servo drive 64 can adjust the force applied to the transfer blanket 6B such that tension is substantially constant at one or more of the decoration transfer position 25 and print areas proximate to one or more of the digital print units 4A-4D. By keeping the blanket tension substantially constant, the load-balancing servo drive 64 reduces "noise" or vibrations in the transfer blanket 6B. This improves the quality of decorations formed by the digital print units 4 as well as reduces distortion or other errors created during transfer of the decorations to a metallic container 22 at the transfer position 25.

In another embodiment, the servo drive 64 is operable to adjust a rate of rotation of the transfer blanket 6B to substantially match a rotation rate of a cylindrical exterior surface 24 of a metallic container 22 during transfer of a decoration 7 to the metallic container. In one embodiment, the control system 12 is operable to alter the rate of rotation of the servo drive 64 to adjust the rotation rate of the transfer blanket 6B. More specifically, the control system 12 may send a signal to the servo drive 64 to set a rate at which the transfer blanket 6B rotates.

In one embodiment, feed unit 8A is operable to rotate a metallic container 22 such that the exterior surface 24 moves at a rate substantially equal to a rate of rotation of the transfer blanket 6B. In one embodiment, the surface speed of the rotating container 22 is substantially equal to the rate of rotation of the impression roller 62. In this manner, dynamic effect to the transfer blanket 6B is minimized. Optionally, the feed unit 8A may include mandrels 11 to support the metallic containers 22 similar to feed unit 8A described in conjunction with FIG. 1. The mandrels 11 may rotate the metallic containers 22 in contact with the transfer blanket 6B at the transfer point 25. In one embodiment, the mandrels 11 rotate at a rate substantially equal to the rate of rotation of the transfer blanket 6B. In another embodiment, the control system 12 may send signals to the mandrels 11 to control the rotation of the mandrels. In one embodiment, a servo drive or other electrical or mechanical means is operable to rotate the mandrels 11. Optionally, the mandrels 11 are the same as, or similar to mandrels of decorator 2A. Accordingly, the mandrels 11 may rotate in response to a force received from a belt or chain interconnected to a drive unit 64.

The feed unit 8A may be arranged in a different position with respect to the transfer blanket 6B. For example, in one embodiment the feed unit 8A is positioned such that metallic containers 22 may be transferred to the feed unit 8A by gravity. Accordingly, in one embodiment, the feed unit 8A is positioned proximate to one of the rotary tensioner 60 and the servo drive 64. Optionally, in another embodiment, the feed unit 8A is positioned proximate to curing unit 16D.

In one embodiment of the present invention, the transfer blanket 6B may rotate at between about 150 and about 250 meters per minute. When the transfer blanket 6B rotates at approximately 200 meters per minute, the decorator 2B may decorate between about 700 and about 900 metallic containers per minute. In another embodiment, at a rotation rate of about 200 meters per minute, the decorate decorates between about 725 and about 775 metallic containers per minute.

Figure 3E:
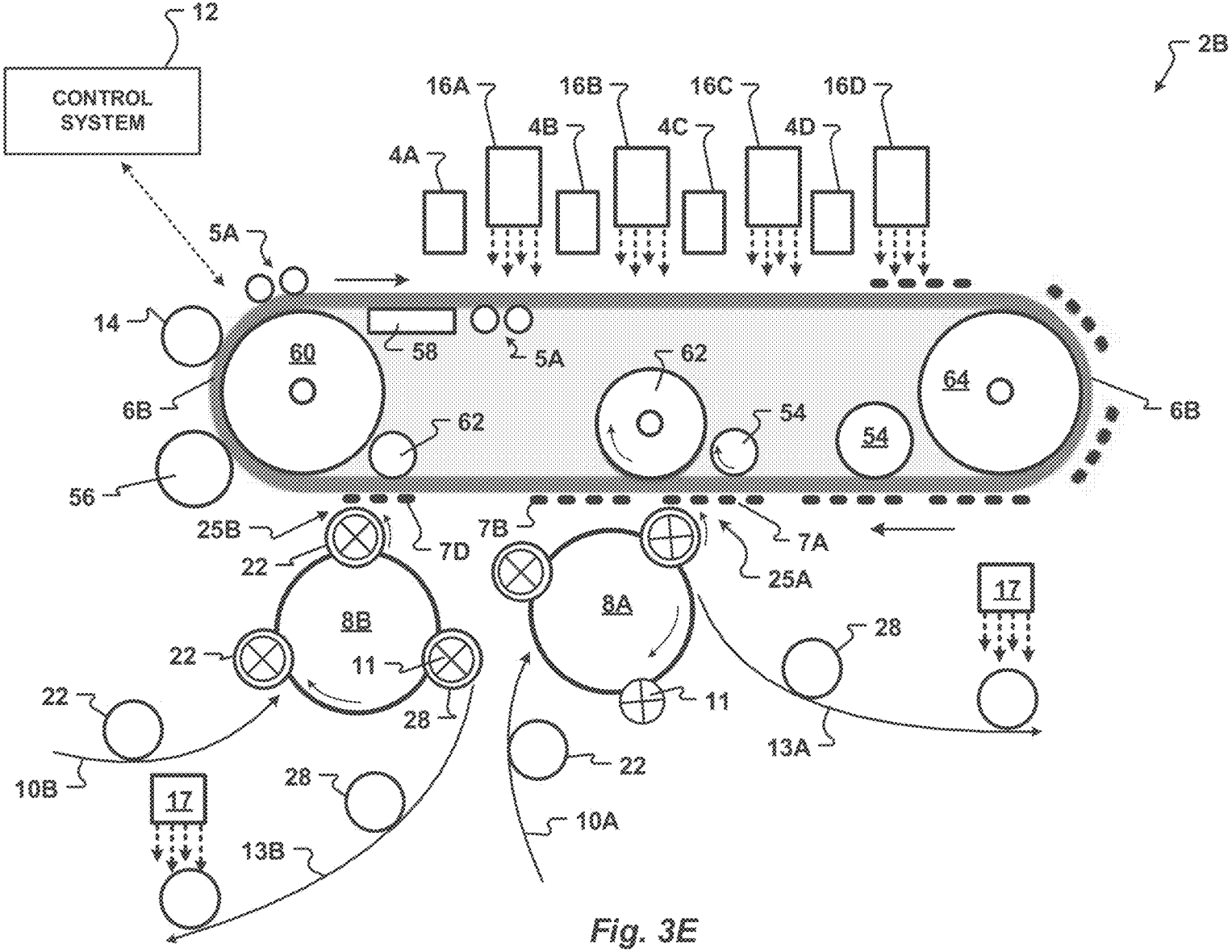
FIG. 3E is a schematic flow diagram of the decorator of FIG. 3 associated with two feed units.

Referring now to FIG. 3E, decorator 2B may optionally include two feed units 8. The feed units 8 may be positioned with respect to the transfer blanket 6B such that there are two image transfer positions 25A, 25B. More specifically, a first feed unit 8A may be positioned upstream of a second feed unit 8B relative to the transfer blanket 6B. In this manner, the first and second feed units 8 may sequentially decorate metallic containers 22 from one or more production lines. In one embodiment, the first feed unit 8A moves metallic containers 22 into contact with every other decoration 7 on the transfer blanket 6B. For example, decoration 7A is transferred to a metallic container 22 arranged on a mandrel 11 of feed unit 8A. However, decorations 7B, 7D move past feed unit 8A and are transferred to metallic containers 22 moved into contact with the transfer blanket 6B by the second feed unit 8B. As shown in FIG. 3E, a blank space on the transfer blanket 6B separates decoration 7B from decoration 7D. The blank space represents a position of the transfer blanket 6B which previously included a decoration that has been transferred to a metallic container supported by the first feed unit 8A. Optionally, feed unit 8A may rotate in a first direction and feed unit 8B may rotate in a second opposite direction.

Figure 4:
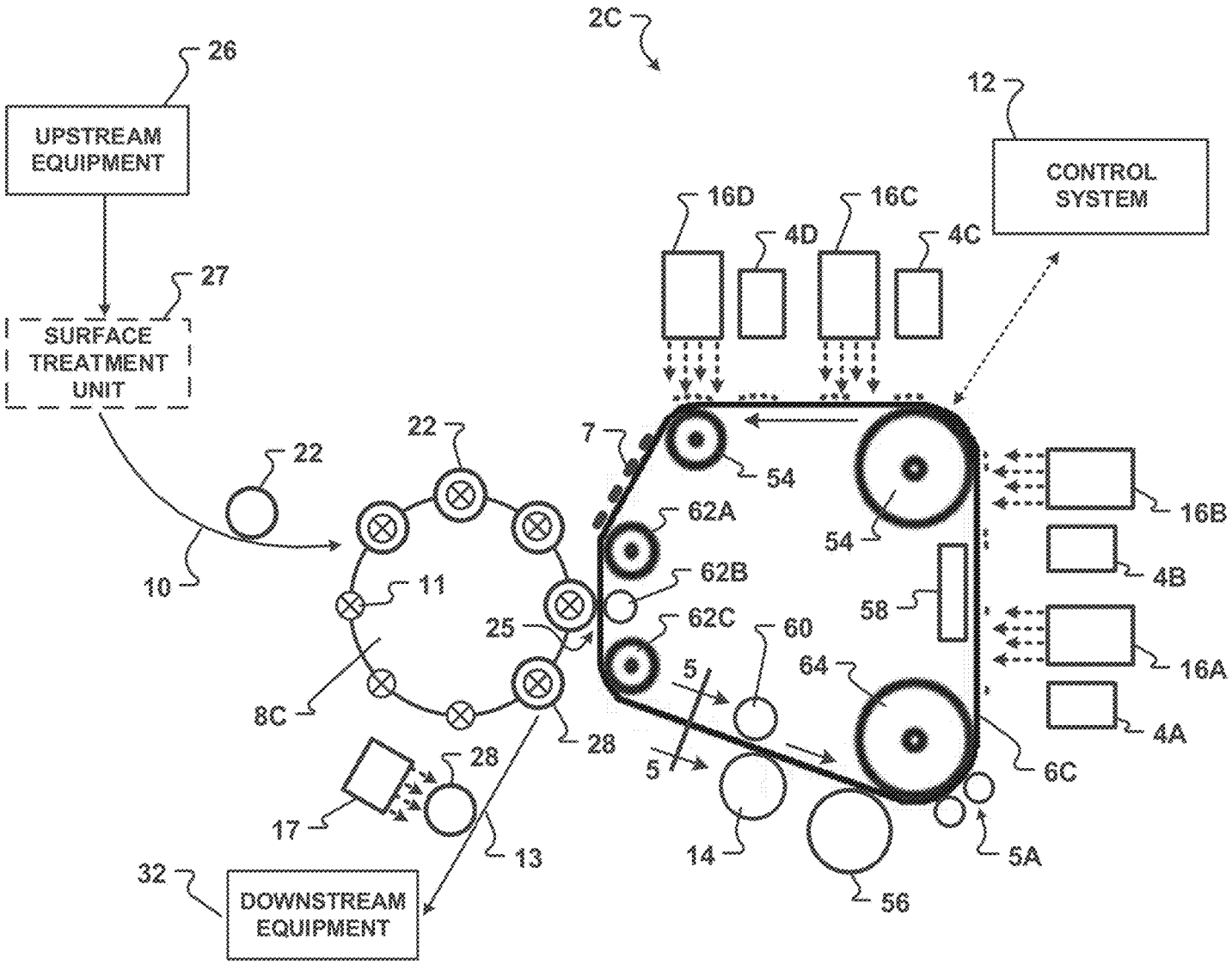
FIG. 4 is still another schematic flow diagram of another embodiment of a decorator of the present invention which includes a feed unit with a plurality of mandrels.

Referring now to FIG. 4, another embodiment of a decorator 2C of the present invention is illustrated. Decorator 2C is similar to decorator 2B and includes a single transfer blanket 6C that is continuous as well as a digital print unit 4 and a feed unit 8. The transfer blanket 6C may be the same as, or similar to, transfer blanket 6B of decorator 2B. Notably, the transfer blanket 6C has a different path compared to transfer blanket 6B. More specifically, transfer blanket 6C follows an irregular path around a plurality of tensioning units 54-62 and servo drives 64 with respect to the digital print units 4 and the curing units 16.

In one embodiment, the feed unit 8C includes a plurality of mandrels 11 to position the metallic containers 22 in contact with the transfer blanket 6. The mandrels 11 may rotate in one or more directions. In one embodiment, a servo drive is associated with the mandrels 11. In one embodiment, a servo drive is associated with each of the mandrels. The servo drive may selectively rotate an associated mandrel. In another embodiment, the servo drive is controlled by a signal from the control system 12. More specifically, the control system 12 may send a signal to a servo drive to rotate a mandrel 11 in a specific direction at a specific rate. Optionally, in another embodiment, a mechanical or electrical means is operable to rotate the mandrels 11. In another embodiment, a torque motor is associated with the mandrels 11. Examples of mandrels that may be used with the feed units 8 of the present invention are described in U.S. Pat. Nos. 8,596,624 and 8,708,271 which are each incorporated herein by reference in their entireties.

In one embodiment, decorator 2C includes one or more tensioning devices 54-62 similar to decorator 2B. The tensioning devices may be arranged at various positions with respect to the transfer blanket 6C. In one embodiment, decorator 2C includes at least one of an inside idler 54, a backside idler 56, a shoe tensioner 58, a rotary tensioner 60, and an impression roller 62. Optionally, the order, arrangement, and number of the tensioning devices 54-62 may be altered. For example, in one embodiment, decorator 2C may include one impression roller 62. In another embodiment, decorator 2C includes three impression rollers 62. Optionally, a first impression roller 62A may be positioned upstream of the decoration transfer position 25. In another embodiment, an impression roller 62B is positioned proximate to the transfer position 25. Additionally, an optional impression roller 62C may be positioned downstream of the transfer position 25.

The tensioning devices 54, 56, 60, and 62 may be freewheeling. Additionally, or alternatively, at least one of the tensioning devices 54, 56, 60, and 62 may be associated with a servo drive to provide a rotational force to the transfer blanket 6C. In one embodiment, one or more of the tensioning devices 54-62 is moveably arranged with respect to the transfer blanket 6C. Accordingly, the tensioning devices 54-62 may be moved into, and out of, contact with the transfer blanket 6C. In one embodiment, the control system 12 can send a signal to an actuator associated with a tensioning device 54-62 to alter a position of the tensioning device. In this manner, the control system 12 can adjust the tension of the transfer blanket 6C.

Decorator 2C may also include at least one servo drive 64. Servo drive 64 may be the same as, or similar to, the servo drive 64 of decorator 2B. Accordingly, the servo drive 64 may rotate substantially continuously. In another embodiment, the servo drive 64 rotates intermittently such that the transfer blanket 6C alternates between periods of movement and stationary periods. In one embodiment, the servo drive 64 is controlled by the control system 12. More specifically, the control system 12 may send signals to the servo drive 64 to alter a rate of rotation of the servo drive, to start rotation of the servo drive, and to stop the servo drive.

Optionally, the decorator 2C can include at least one temperature control device 5A configured to heat or cool the transfer blanket 6C. The temperature control device 5A can be positioned to contact an exterior surface or an interior surface of the transfer blanket 6C.

Figure 5:
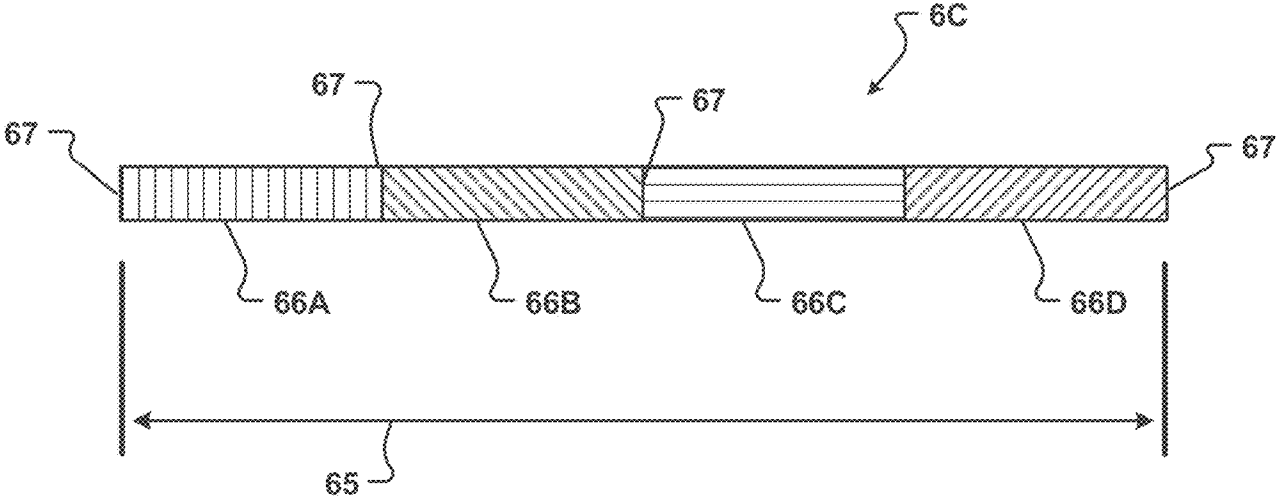
FIG. 5 is a cross-sectional view of a transfer blanket of one embodiment of the present invention taken along line 5-5 of FIG. 4.

Referring now to FIG. 5, in one embodiment, a transfer blanket 6 may comprise at least two segments 66. More specifically, in one embodiment, transfer blanket 6C comprises a plurality of segments 66A-66D. In one embodiment, each segment 66 is generally parallel to one or more adjacent segments. Optionally, each segment 66 may be of substantially the same size and shape. In another embodiment, the segments 66 are formed of the same materials. In another embodiment, at least one segment 66A comprises a different material than segments 66B-66D.

Optionally, a segment 66B may be interconnected to at least one adjacent segment 66A, 66C along a longitudinal edge 67. In another embodiment, the segments 66 are interconnected along longitudinal edges 67 at least proximate to transfer position 25 when decorating material is transferred to a metallic container 22.

The transfer blanket 6C has a width 65. In one embodiment, the width 65 may be at least equal to a height of a metallic container 22 to be decorated. In one embodiment, the width 65 is greater than the container height.

In one embodiment, the segments 66 are not interconnected. Accordingly, in one embodiment, tension of the segments 66 may be individually adjusted. For example, in one embodiment, one or more of the tensioning devices 54-62 may selectively adjust the tension of one or more the segments 66.

In another embodiment, at least one servo drive 64 is associated with each segment 66. In this manner, the rate of rotation of each segment 66 may be selectively adjusted in relation others of the segments. Further, one segment 66A may stop while other segments continue to rotate 66B-66D. Although only four segments 66A-66D are illustrated in FIG. 5, one skilled in the art will appreciate that transfer blanket 6C may include any number of segments 66.

In another embodiment, at least one segment 66A may follow a different path through decorator 2C compared to one or more of segments 66B-66D. In this manner, at least one segment 66 may bypass one or more of the digital print units 4. Optionally, at least one segment 66 may have a different length than another segment 66. Alternatively, at least one segment 66 may receive decorating material from a digital print unit 4 that does not transfer decorating material to one or more of the other segments 66.

The segments 66 of transfer blanket 6C provide many benefits. In one embodiment, more metallic containers 22 may be decorated by a transfer blanket 6 including segments 66. More specifically, the rotation rate of a transfer blanket 6 is generally limited by the speed at which digital print units 4 may transfer decorating material to the transfer blanket. Parallel blanket segments 66 multiply output of the same base metallic container handling unit, such as a feed unit 8. Additionally, the blanket segments 66 provide redundancy. This ensures a steady output of decorated metallic containers from the decorator. More specifically, in one embodiment, each segments 66 may operate independently. Accordingly, if one segments 66 stops, other segments may continue to rotate with respect to the digital print units. Further, separate blanket segments 66 may isolate the blankets from noise generated during image transfer to the metallic containers. For example, if each blanket segment 66 is associated with a separate feed unit 8, such as described in conjunction with FIG. 5A, vibration and noise in the transfer blanket 6C generated during image transfer will be reduced. Noise in the transfer blanket 6C may be further reduced by transferring decorations from a first segment 66A to a metallic container at a different time than decorations on a second segment 66B are transferred to a different metallic container.

The separate blanket segments 66 may also result in different operating temperatures for the segments. This may further reduce wear and deterioration on the transfer blanket 6C.

In another embodiment, a feed unit 8 of a decorator 2 may be associated with each segment 66 of a transfer blanket 6. More specifically, and referring now to FIG. 5A, a partial cross-sectional view of a decorator 2D of yet another embodiment of the present invention is generally illustrated. Decorator 2D is similar to decorators 2B, 2C and generally includes digital print units 4, a cleaning system 14, curing units 16, 17, tensioning devices 54-60, and a servo drive 64 which are not illustrated for clarity. Notably, decorator 2D includes a continuous transfer blanket 6D comprising two segments 66A, 66B which are aligned with respect to two feed units 8 at image transfer positions 25A, 25B. An impression roller 62 is positioned to support the transfer blanket 6D during contact with metallic containers. Optionally, two separate impression rollers 62A, 62B may be associated with each blanket segment 66. In this manner, the digital print units 4 may transfer decorating material, such as an ink or a toner, to the transfer blanket 6D forming images 7. The first segment 66A of transfer blanket 6D may then transfer an image 7A to a first metallic container 22A. The second segment 66B similarly can transfer a second image 7B to a second metallic container 22B. Optionally, segments 66A, 66B may rotate through decorator 2D at the same rate or at different rates. In one embodiment, decorator 2D may decorate between about 1,400 and 1,600 containers per minute when the transfer blanket 6D is rotating at approximately 200 meters per minute.

Additionally, in one embodiment, the first metallic container 22A may be associated with a first production line and the second metallic container 22B may be associate with a second production line. More specifically, the first metallic container 22A may be of a different size, shape, or material compared to the second metallic container 22B. Accordingly, in one embodiment of the present invention, a decorator 2 of the present invention may be integrated into two different container production lines.

Figure 5A:
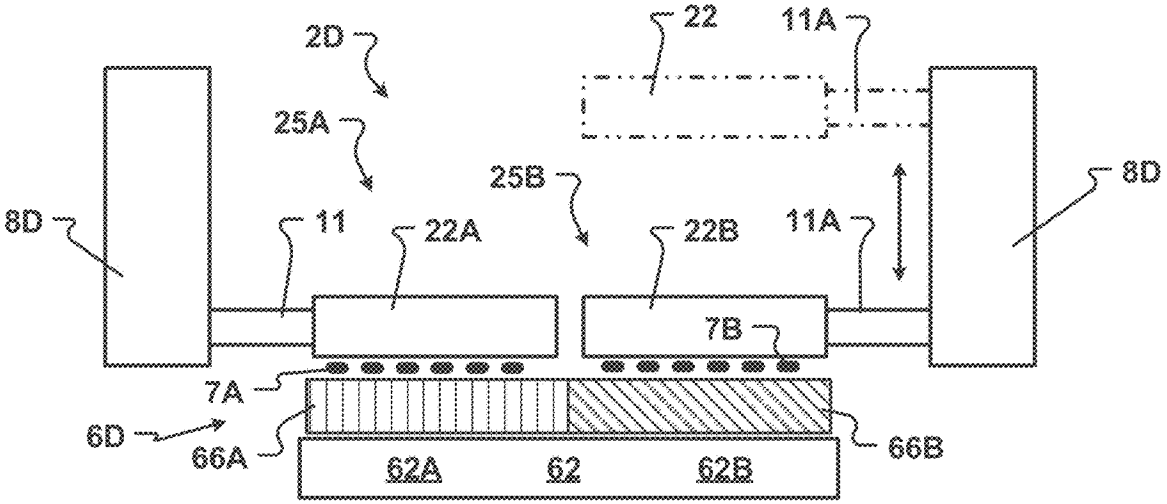
FIG. 5A is a partial cross-sectional view of a decorator of another embodiment of the present invention including two feed units.

FIG. 5A also illustrates a mandrel 11A of one embodiment of the present invention. Optionally, mandrel 11A may move relative to the transfer blanket 6D. More specifically, in one embodiment, the mandrel 11A is moveably interconnected to feed unit 8. Optionally, an actuator may be associated with the mandrel 11A. In this manner, the mandrel may selectively move a metallic container 22 thereon into contact with the transfer blanket and out of contact with the transfer blanket.

Although blanket 6D is illustrated with two segments 66 aligned with two feed units 8, any number of segments 66 and feed units 8 may be used with a decorator 2 of the present invention. More specifically, in another embodiment, blanket 6C illustrated in FIG. 5 may be associated with four feed units 8. In one embodiment, a decorator 2 including four feed units 8 associated with four segments 66 of a transfer blanket 6 may decorate between about 1,850 and about 2,100 containers per minute when the transfer blanket 6 is rotating at approximately 200 meters per minute.

Figure 6:
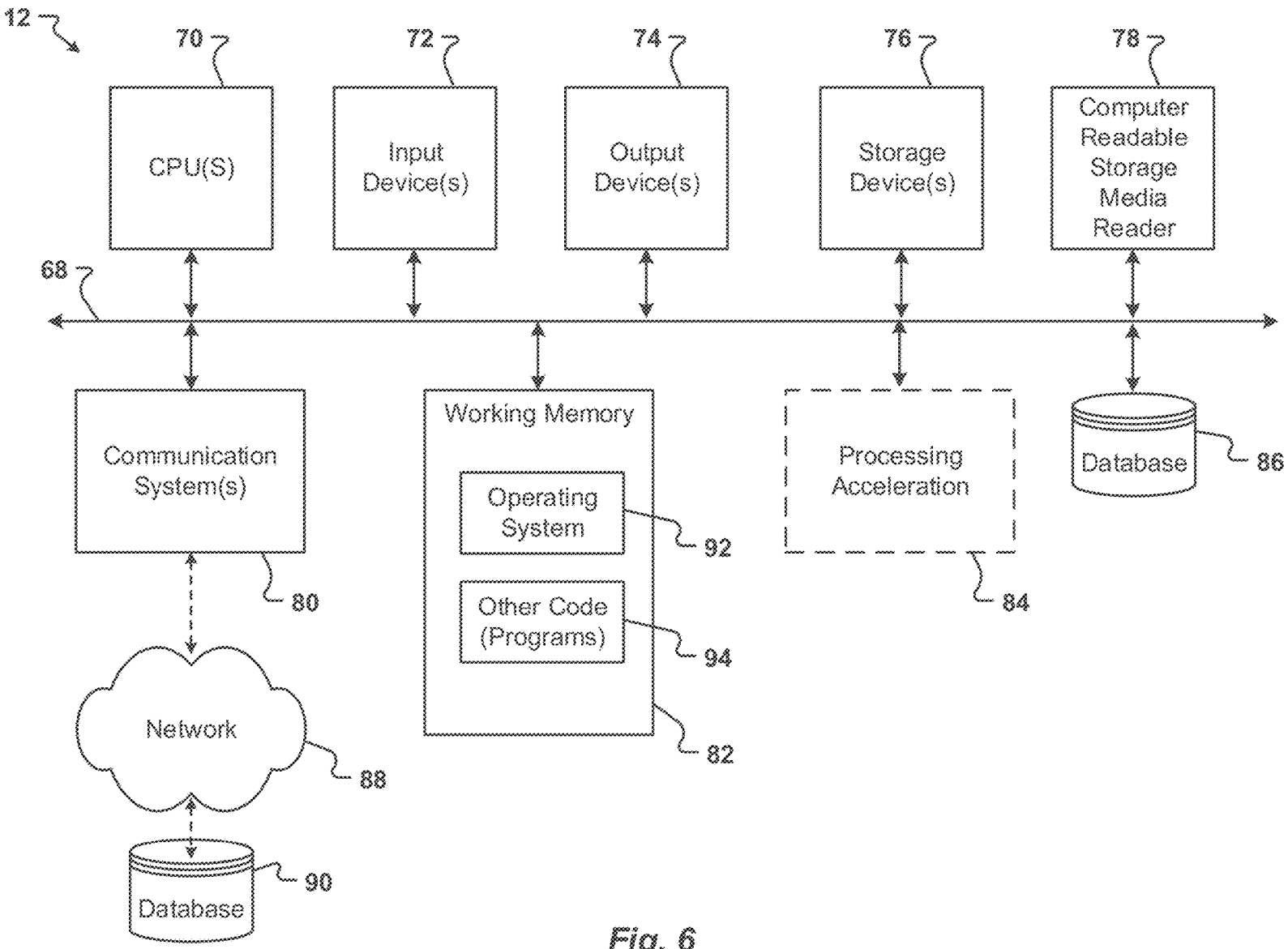
FIG. 6 is a block diagram of an embodiment of a control system of the present invention.

Referring now to FIG. 6, a control system 12 of one embodiment of the present invention is generally illustrated. The control system 12 is generally illustrated with hardware elements that may be electrically coupled via a bus 68. The hardware elements may include one or more central processing units (CPUs) 70; one or more input devices 72 (e.g., a mouse, a keyboard, etc.); and one or more output devices 74 (e.g., a display device, a printer, etc.). The control system 12 may also include one or more storage devices 76. In one embodiment, the storage device(s) 76 may be disk drives, optical storage devices, solid-state storage device such as a random access memory ("RAM") and/or a read-only memory ("ROM"), which can be programmable, flash-updateable and/or the like.

The control system 12 may additionally include one or more of a computer-readable storage media reader 78; a communications system 80 (e.g., a modem, a network card (wireless or wired); an infra-red communication device, etc.); and working memory 82, which may include RAM and ROM devices as described above. In some embodiments, the control system 12 may also include a processing acceleration unit 84, which can include a DSP, a special-purpose processor and/or the like. Optionally, the control system 12 also includes a database 86. The database may include information related to decorations 23 applied to metallic containers 22 by upstream equipment 26. Additionally, or alternatively, the database 86 can include information describing decorations 7 to be formed by a decorator 2 of the present invention.

The computer-readable storage media reader 78 can further be connected to a computer-readable storage medium, together (and, optionally, in combination with storage device (s) 76) comprehensively representing remote, local, fixed, and/or removable storage devices plus storage media for temporarily and/or more permanently containing computer-readable information. The communications system 80 may permit data to be exchanged with a network 88 and/or any other data-processing. Optionally, the control system 12 may access data stored in a remote storage device, such as database 90 by connection to the network 88. In one embodiment, the network 88 may be the internet.

The control system 12 may also comprise software elements, shown as being currently located within the working memory 82. The software elements may include an operating system 92 and/or other code 94, such as program code implementing one or more methods and aspects of the present invention. In one embodiment, instructions to send signals to a digital print unit 4 to form a decoration 7 are stored in the working memory 82. In another embodiment, working memory 82 includes instructions related to signals to be sent to the exposure element 46 to form a decoration 7 on a conductor 42. Optionally, the working memory 82 may include instructions related to aspects of one or more of a decorator 2, a digital print unit 4, a feed unit 8, mandrels 11, a cleaning system 14, a curing unit 16, 17, a blanket wheel 18, upstream equipment 26, a surface treatment unit 27, downstream equipment 32, an electrophotographic system 40, an actuator associated with tensioning devices 54-62 of decorators 2B, 2C, a servo drive 64, and an impression roller 62. Accordingly, in one embodiment, the control system 12 can send signals to one or more of the digital print units 4, the feed unit 8, mandrels 11, curing units 16, 17, and the blanket wheel 18, and a servo drive 64 to synchronize the operation of a decorator 2. In this manner, the control system 12 can send signals to a digital print unit 4 to form decorations 7 on a transfer blanket 6 such that a decoration 7 is registered with a metallic containers 22 on a feed unit 8.

One of skill in the art will appreciate that alternate embodiments of the control system 12 may have numerous variations from that described above. For example, customized hardware might also be used and/or particular elements might be implemented in hardware, software (including portable software, such as applets), or both. Further, connection to other computing devices such as network input/output devices may be employed.

The control system 12 may be in communication with one or more of the decorators 2, the digital print units 4, the feed unit 8, the inbound conveyor 10, the outbound conveyor 13 the cleaning system 14, the optional curing units 16, 17, the blanket wheel 18, tensioning devices 54-62, and servo drive 64. The control system 12 may send signals to the digital print units 4 to adjust a location of a decoration 7 formed on a transfer blanket 6. The control system 12 is also operable, in one embodiment, to provide unique signals to each of the digital print units 4 to form unique decorations 7 on each of the transfer blankets 6. Accordingly, the control system 12 may send a unique design for each decoration 7 to the digital print units 4.

Suitable control systems 12 are known to those of skill in the art. In one embodiment, the control system 12 is a personal computer, such as, but not limited to, a personal computer running the MS Windows operating system. Optionally, the control system 12 may be a tablet computer, a laptop computer, and similar computing devices. In one embodiment, the control system 12 is a data processing system which includes one or more of, but is not limited to: at least one input device (e.g. a keyboard, mouse, or touch-screen); at an output device (e.g. a display); a graphics card; a communication device (e.g. an Ethernet card or wireless communication device); permanent memory (such as a hard drive); temporary memory (for example, random access memory); and a processor. The control system 12 may be any programmable logic controller (PLC). One example of a suitable PLC is a Controllogix PLC produced by Rockwell Automation, Inc., although other PLCs are contemplated for use with embodiments of the present invention.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. An apparatus for applying a decoration to an exterior surface of a metallic container, comprising:

a first transfer blanket segment connected to a first blanket support, wherein the first blanket support has a length that is variable;

a print unit in a predetermined alignment with respect to the first transfer blanket segment, the print unit operable to convey a decorating material to the first transfer blanket segment to form a decoration on the first transfer blanket segment; and a feed unit to move the metallic container into contact with the first transfer blanket segment to transfer the decoration from the first transfer blanket segment to the exterior surface of the metallic container, wherein the first blanket support extends outwardly to press the first transfer blanket segment against the exterior surface of the metallic container in the feed unit.

2. The apparatus of claim 1, wherein the first transfer blanket segment is spaced a first distance from a second transfer blanket segment proximate to the print unit and is spaced a second distance from the second transfer blanket segment proximate to the feed unit, the first distance being different than the second distance.

3. The apparatus of claim 1, wherein the print unit is at least one of:

an inkjet print head, wherein the decorating material is an ink; and an electrophotographic system comprising a conductor, a charging element, an exposure element, and a developer unit which supplies the decorating material, wherein the decorating material is a toner material.

4. The apparatus of claim 1, wherein the first transfer blanket segment moves at a first velocity proximate to the print unit and at a second velocity proximate to the feed unit, the first velocity being slower than the second velocity.

5. The apparatus of claim 1, wherein the first blanket support has a first length proximate to the print unit and a second length proximate to the feed unit, the second length being greater than the first length.

6. The apparatus of claim 1, wherein the metallic container comprises a beverage container, a can, a cup, a bottle preform, or a tube.

7. The apparatus of claim 1 wherein the apparatus is configured to decorate a cylindrical sidewall or a closed end of the metallic container.

8. The apparatus of claim 1, wherein the feed unit is aligned with a first image transfer position of the apparatus and includes a plurality of first mandrels to receive metallic containers, and wherein the apparatus further comprises a second feed unit with a plurality of second mandrels to receive metallic containers, the second feed unit aligned with a second image transfer position of the apparatus that is spaced from the feed unit and the first image transfer position, the second feed unit configured to move a second metallic container into contact with a second transfer blanket segment and support the second metallic container during transfer of a second decoration to an exterior surface of the second metallic container.

9. The apparatus of claim 1, wherein the first transfer blanket segment has a first shape proximate to the print unit and a second shape proximate to the feed unit, the second shape being different from the first shape.

10. A method of applying a decoration to an exterior surface of a metallic container, comprising:

conveying a decorating material from a print unit to a first blanket segment to form a decoration on the first blanket segment, wherein the first blanket segment moves at a first velocity proximate to the print unit;

positioning the metallic container in a first feed unit that is aligned with a first image transfer position, wherein the first feed unit includes a plurality of first mandrels to receive metallic containers, and wherein a second feed unit is aligned with a second image transfer position and includes a plurality of second mandrels to receive metallic containers, the second feed unit configured to move a second metallic container into contact with a second blanket segment and support the second metallic container during transfer of a second decoration to an exterior surface of the second metallic container; and moving the metallic container into contact with the first blanket segment to transfer the decoration from the first blanket segment to the exterior surface of the metallic container, wherein the first blanket segment moves at a second velocity proximate to the first feed unit.

11. The method of claim 10, further comprising:

positioning the first blanket segment a first distance from the second blanket segment proximate to the print unit; and positioning the first blanket segment a second distance from the second blanket segment proximate to the first feed unit, the first distance being different from the second distance, and wherein the first velocity is less than the second velocity.

12. The method of claim 10, wherein the first blanket segment is positioned on a first blanket support, and wherein the method further comprises altering a length of the first blanket support such that the first blanket support has a first length proximate to the print unit and a second length proximate to the first feed unit, the second length being greater than the first length.

13. The method of claim 10, further comprising at least one of:

partially curing the decorating material conveyed to the first blanket segment by a curing unit positioned downstream from the print unit and upstream of the first feed unit; and exposing the decorating material conveyed from the print unit to light from a light emitter positioned in a predetermined alignment with the print unit, wherein the decorating material includes an initiator that alters a viscosity of the decorating material when the light from the light emitter contacts the initiator.

14. The method of claim 10, further comprising transporting the metallic container to downstream equipment after decorating the metallic container, wherein the downstream equipment alters a diameter of a portion of the metallic container, and wherein the metallic container comprises a cup, a bottle preform, or a tube.

15. The method of claim 10, wherein the first blanket segment is associated with a downstream decorator, and wherein the method further comprises:

transporting the metallic container to an upstream decorator that applies a first decoration to the exterior surface of the metallic container; and transporting the metallic container with the first decoration to the downstream decorator, wherein the first blanket segment transfers the decoration to the exterior surface in a predetermined alignment to the first decoration already on the exterior surface.

16. The method of claim 10, further comprising altering a shape of the first blanket segment, wherein the first blanket segment has a first shape proximate to the print unit and a second shape proximate to the first feed unit, the second shape being different from the first shape.

17. An apparatus for applying a decoration to an exterior surface of a metallic container, comprising:

a first transfer blanket segment connected to a first blanket support;

a print unit in a predetermined alignment with respect to the first transfer blanket segment, the print unit operable to convey a decorating material to the first transfer blanket segment to form a decoration on the first transfer blanket segment;

a first feed unit to move the metallic container into contact with the first transfer blanket segment to transfer the decoration from the first transfer blanket segment to the exterior surface of the metallic container, the first feed unit aligned with a first image transfer position of the apparatus, wherein the first feed unit includes a plurality of first mandrels to receive metallic containers, and wherein the first blanket support extends outwardly to press the first transfer blanket segment against the exterior surface of the metallic container supported by the first feed unit; and a second feed unit with a plurality of second mandrels to receive metallic containers, the second feed unit aligned with a second image transfer position of the apparatus that is spaced from the first feed unit and the first image transfer position, the second feed unit configured to move a second metallic container into contact with a second transfer blanket segment and support the second metallic container during transfer of a second decoration to an exterior surface of the second metallic container.

18. The apparatus of claim 17, wherein the first blanket support has a length that is variable.

19. The apparatus of claim 18, wherein the first blanket support has a first length proximate to the print unit and a second length proximate to the first feed unit, the second length being greater than the first length.

20. The apparatus of claim 17, wherein the first transfer blanket segment has a first shape proximate to the print unit and a second shape proximate to the first feed unit, the second shape being different from the first shape.

* * * * *